US007547225B2

(12) United States Patent
Suemitsu et al.

(10) Patent No.: US 7,547,225 B2
(45) Date of Patent: Jun. 16, 2009

(54) ELECTRICAL CONNECTOR ASSEMBLY

(75) Inventors: Yoshifumi Suemitsu, Tokyo (JP); Kazushige Sakamaki, Tokyo (JP); Hiroshi Kobayashi, Aichi (JP)

(73) Assignees: Tyco Electronics AMP K.K., Kanagawa-ken (JP); Toyota Jidosha Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 11/755,279

(22) Filed: May 30, 2007

(65) Prior Publication Data

US 2007/0281512 A1 Dec. 6, 2007

(30) Foreign Application Priority Data

Jun. 2, 2006 (JP) ..... 2006-155018

(51) Int. Cl.
*H01R 13/64* (2006.01)

(52) U.S. Cl. ..... 439/374; 439/680

(58) Field of Classification Search ..... 439/374, 439/680

See application file for complete search history.

(56) References Cited

U.S. PATENT DOCUMENTS 5,425,650 A 6/1995 Maeda
6,089,896 A 7/2000 Kosmala
2004/0102077 A1* 5/2004 Shibata ..... 439/374
2007/0072462 A1 3/2007 Nakano et al.

FOREIGN PATENT DOCUMENTS

JP 10154537 6/1998
JP 2000-315542 11/2000

* cited by examiner

*Primary Examiner*—Gary F. Paumen
(74) *Attorney, Agent, or Firm*—Barley Snyder LLC

(57) ABSTRACT

An electrical connector assembly having a first connector comprising a first housing comprising a complementary connector receiving concavity, a first contact attached to the first housing, a first connector projection, and a first connector concavity, a complementary connector that mates with the first connector comprising a complementary housing received by the complementary connector receiving concavity, the complementary housing comprising a complementary contact attached to the complementary housing, a groove, and a side projection, where displacement of the complementary housing with respect to the first housing in a vertical direction is restricted by the first connector projection being received in the groove and by the side projection being received in the first connector concavity is disclosed.

8 Claims, 19 Drawing Sheets

PRIOR ART

ELECTRICAL CONNECTOR ASSEMBLY

CROSS-REFERENCE TO RELATED APPLICATIONS

This application claims the benefit of the filing date under 35 U.S.C. § 119(a)-(d) of Japanese Patent Application No. 2006-155018, filed Jun. 2, 2006.

FIELD OF THE INVENTION

The present invention relates to the field of electrical connectors, and more specifically, to electrical connector assemblies having a first part and a complementary part for mating with the first part.

BACKGROUND

Electrical connector assemblies comprising a female-type connector and a male-type connector that mates with this female-type connector have been used in the past, for example, for the purpose of electrically connecting an automotive circuit board and electrical wiring. Here, a female-type connector generally comprises a female-type housing and a plurality of male-type contacts attached to this female-type housing and connected to a circuit board. Meanwhile, a male-type connector generally comprises a male-type housing received by the female-type housing and female-type contacts that are attached to this male-type housing and connected to electrical wires and that make contact with the male-type contacts.

In recent years, furthermore, there has been demand for a reduction in the height and width (pitch) of such electrical connector assemblies used for the purpose of electrically connecting an automotive circuit board and electrical wiring, so that a reduction in the height and width of female-type connectors and male-type connectors is required.

Here, for example, the female-type connector shown in Prior Art FIGS. 18 and 19 (see JP-A-10-154537) has been known as a female-type connector whose height can be lowered and which is therefore suitable for automotive use. Prior Art FIG. 18 is a front view of a conventional female-type connector. Prior Art FIG. 19 is a sectional view along line 19-19 in Prior Art FIG. 18.

In Prior Art FIGS. 18 and 19, the female-type connector 101 comprises a female-type housing 110, a plurality of male-type contacts 120 attached to the female-type housing 110, and a tine plate 130.

Here, the female-type housing 110 is formed in a rectangular solid shape extending in the direction of length (left-right direction in Prior Art FIG. 18) by molding an insulating resin. A plurality of screw attachment parts 112 and a plurality of standoffs 119 are provided on the undersurface of the female-type housing 110, so that the female-type housing 110 is mounted on a circuit board PCB via these screw attachment parts 112 and standoffs 119. Each of the screw attachment parts 112 is provided with a screw hole 113 into which an attachment screw 140 for the attachment of the female-type housing 110 to the surface of the circuit board PCB is screwed. Furthermore, a plurality of male-type connector receiving recessed parts 111*a* through 111*e* for receiving male-type connectors 150 that are inserted in the direction indicated by arrow A in Prior Art FIG. 19 are formed inside the female-type housing 110. The plurality of male-type connector receiving recessed parts 111*a* through 111*e* are arranged along the direction of length. A locking part 116 that locks with the locking arm (not shown in the figures) of the corresponding male-type connector 150 and maintains the state of mating with this male-type connector 150 is provided on the lower side of the upper wall 114 of each of the male-type connector receiving recessed parts 111*a* through 111*e*. Moreover, projecting ribs 117 that extend from the upper wall 114 toward the lower wall 115 and projecting ribs 118 that extend from the lower wall 115 toward the upper wall 114 are provided on the respective male-type connector receiving recessed parts 111*a* through 111*e*. These projecting ribs 117 and 118 have the functions of preventing deformation (preventing so-called twisting) of the male-type contacts 120 caused by the corner parts or the like of the male-type connectors 150, preventing the insertion (keying) of a similar but different type of male-type connector 150 accomplished by varying the position for each of the male-type connector receiving recessed parts 111*a* through 111*e*, and preventing the upside-down insertion of the male-type connectors 150.

In addition, each of the male-type contacts 120 comprises a fastening part 121 that is press-fitted to the female-type housing 110, a tab-form contact part 122 that extends from the fastening part 121 into the corresponding one of male-type connector receiving recessed parts 111*a* through 111*e* and that contacts a female-type contact (not shown in the figures) provided on the corresponding male-type connector 150, and a leg part 123 that extends in the outward direction (toward the left in Prior Art FIG. 19) from the fastening part 121 and extends toward the circuit board PCB after being bent at an intermediate point. The respective leg parts 123 are designed to be electrically connected to the circuit board PCB. Furthermore, each of the male-type contacts 120 is formed by stamping and forming a metal plate.

Moreover, the tine plate 130 is formed in a flat plate form and constructed so as to align the leg parts 123 of the respective male-type contacts 120 with through-holes PCB1 in the circuit board PCB.

In addition, the mating male-type connectors 150 are inserted into the respective male-type connector receiving recessed parts 111*a* through 111*e* of the female-type connector 101 in the direction indicated by arrow A in Prior Art FIG. 19, and the female-type contacts provided on the male-type connectors 150 contact the contact parts 122 of the male-type contacts 120, so that the electrical wires (not shown in the figures) connected to the female-type contacts and the circuit board PCB connected to the male-type contacts 120 are electrically connected to each other. In the state of mating between the male-type connectors 150 and female-type connector 101, the locking arms of the male-type connectors 150 are locked with the locking parts 116 of the female-type connector 101. In this mating state, furthermore, the tab-form contact parts 122 of the male-type contacts 120 of the female-type connector 101 are received by and make contact with the female-type contacts of the male-type connectors 150. Accordingly, the male-type connectors 150 are prevented from being pulled out of the female-type connector 101 by the locking force of the locking arms of the male-type connectors 150 and the locking parts 116 of the female-type connector 101 as well as the contact force of the female-type contacts of the male-type connectors 150 and the male-type contacts 120 of the female-type connector 101.

However, the following problems have been encountered in the female-type connector 101 shown in Prior Art FIGS. 18 and 19:

Specifically, in the female-type connector 101, the upper wall 114 and lower wall 115 of the female-type housing 110 are formed to be relatively thin to meet the requirement of a height reduction, and in the state of mating between the male-type connectors 150 and female-type connector 101, the male-type connectors 150 are prevented from being pulled out of the female-type connector 101 by the locking force between the locking arms of the male-type connectors 150 and the locking parts 116 of the female-type connector 101 and also by the contact force between the female-type contacts of the male-type connectors 150 and the male-type contacts 120 of the female-type connector 101.

However, in the mating state of the male-type connectors 150 and female-type connector 101, for example, when the rear side (right side in Prior Art FIG. 19) of any of the male-type connectors 150 is driven in the vertical direction (direction of arrow B in Prior Art FIG. 19), because the upper wall 114 and lower wall 115 of the female-type housing 110 are thin in the female-type connector 101, this upper wall 114 or lower wall 115 undergoes deformation, so that the driving of this male-type connector 150 cannot be restricted. Therefore, there is a danger that the female-type contacts of the male-type connector 150 and the male-type contacts 120 of the female-type connector 101 that contact each other will be deformed. Furthermore, when the rear side of any of the male-type connectors 150 is driven in the vertical direction, there is also a danger that the upper wall 114 or lower wall 115 will be destroyed. Because the female-type connector 101 is mounted on a circuit board PCB, the male-type connector 150 that mates with this female-type connector 101 tends to be driven in the upward direction. Here, "driving" refers to the displacement of the rear side of a male-type connector 150 in the vertical direction.

On the other hand, if the upper wall 114 and lower wall 115 of the female-type housing 110 are made thicker in the female-type connector 101 in order to restrict the driving of the male-type connectors 150, then this will work against the height reduction requirement.

BRIEF SUMMARY

Accordingly, the present invention was devised in order to solve the problems described above; it is an object of the present invention to provide an electrical connector assembly that can exhibit strength against the driving of a complementary connector in the vertical direction without increasing the wall thickness of the first housing in the first connector.

The present invention relates to an electrical connector assembly having a first connector comprising a first housing comprising a complementary connector receiving concavity, a first contact attached to the first housing, a first connector projection, and a first connector concavity, a complementary connector that mates with the first connector comprising a complementary housing received by the complementary connector receiving concavity, the complementary housing comprising a complementary contact attached to the complementary housing, a groove, and a side projection, where displacement of the complementary housing with respect to the first housing in a vertical direction is restricted by the first connector projection being received in the groove and by the side projection being received in the first connector concavity.

BRIEF DESCRIPTION OF THE DRAWINGS

Prior Art

DETAILED DESCRIPTION OF THE EMBODIMENT(S)

Figure 1A:
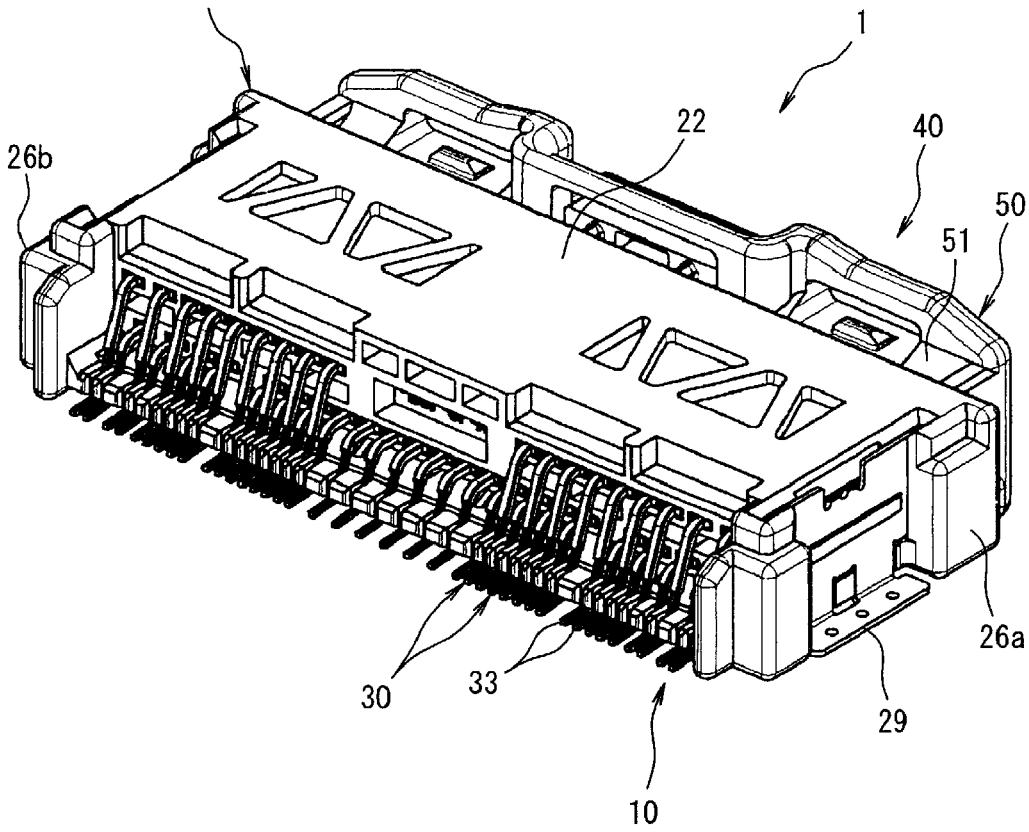
FIG. 1A is an oblique view of an electrical connector assembly according to an embodiment of the present invention as seen from the back and from above.
Figure 1B:
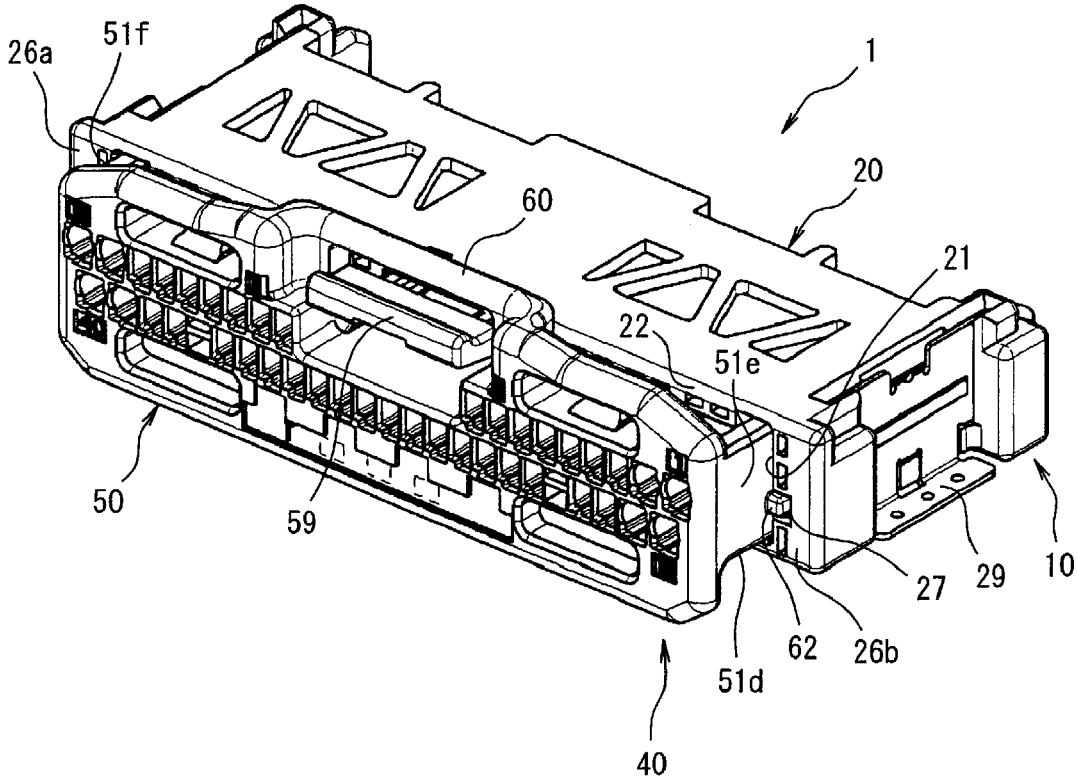
FIG. 1B is an oblique view of the electrical connector assembly of FIG. 1A as seen from the front and from above.
Figure 2:
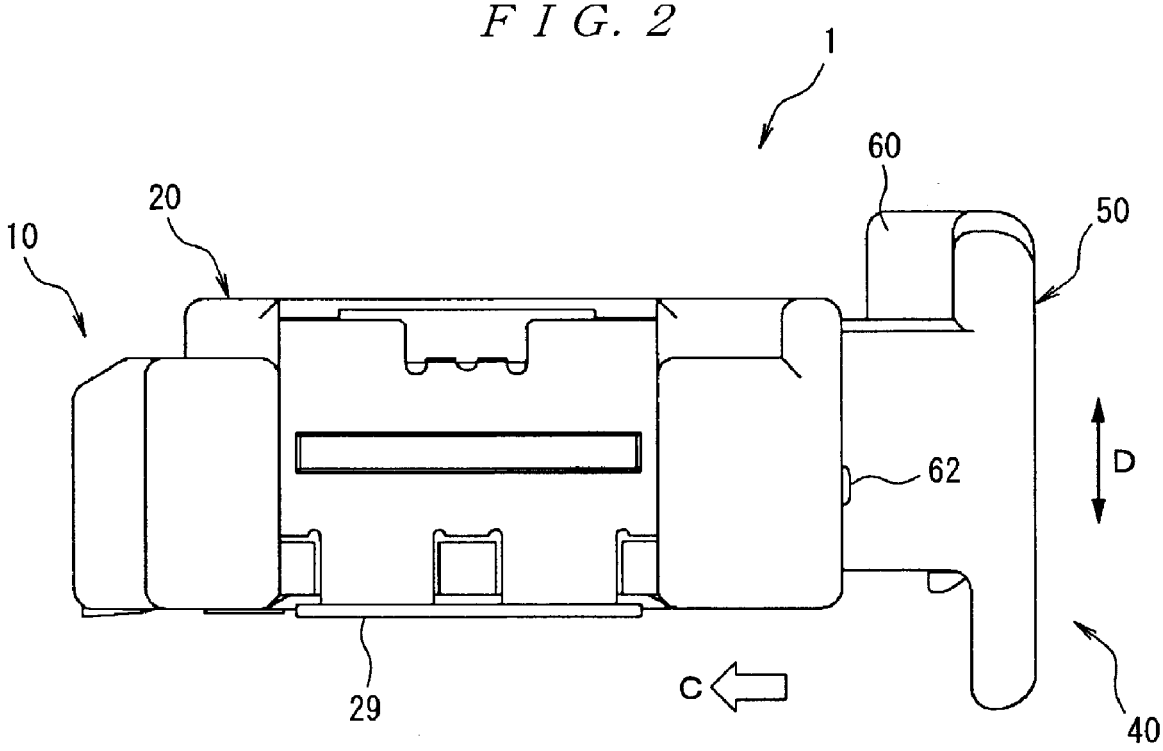
FIG. 2 is an orthogonal diagram view of the electrical connector assembly of FIG. 1A as seen from the left side surface of a first connector of the electrical connector assembly of FIG. 1A.

Next, an embodiment of the present invention will be described with reference to the figures. As is shown in FIGS. 1A, 1B, and 2, an electrical connector assembly 1 consists of a first connector 10 and a complementary connector 40 that mates with this first connector 10 in the mating direction (direction indicated by arrow C in FIG. 2). This embodiment is further shown in FIGS. 3A-5B.

Figure 3A:
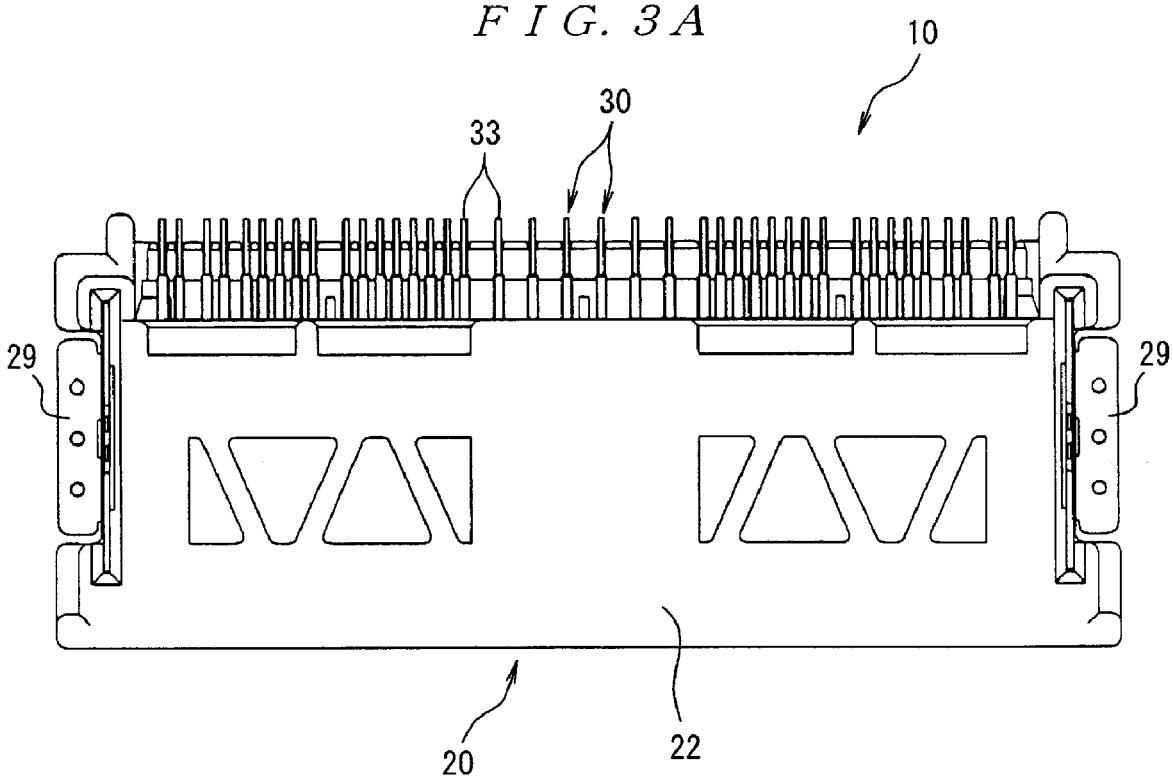
FIG. 3A is an orthogonal view of the first connector of FIG. 1A as seen from above.
Figure 3B:
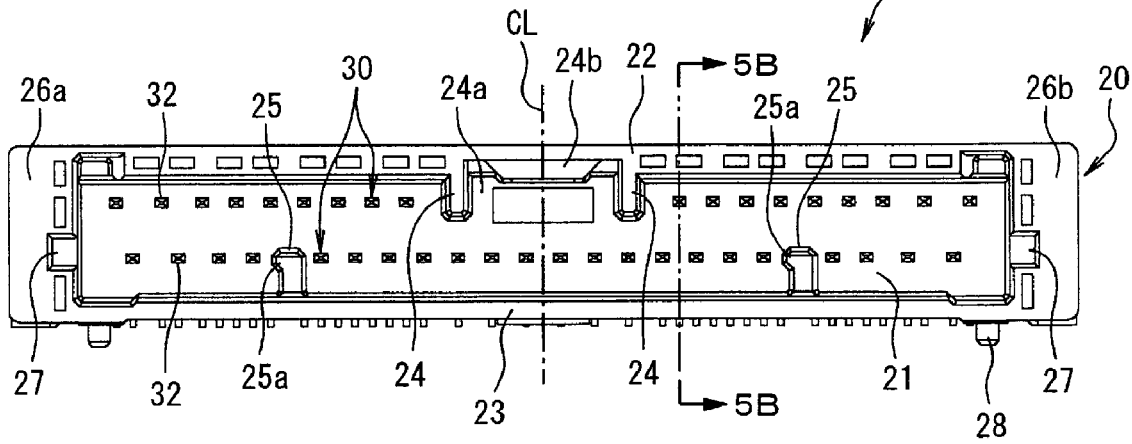
FIG. 3B is an orthogonal view of the first connector of FIG. 1A as seen from the front.
Figure 4A:
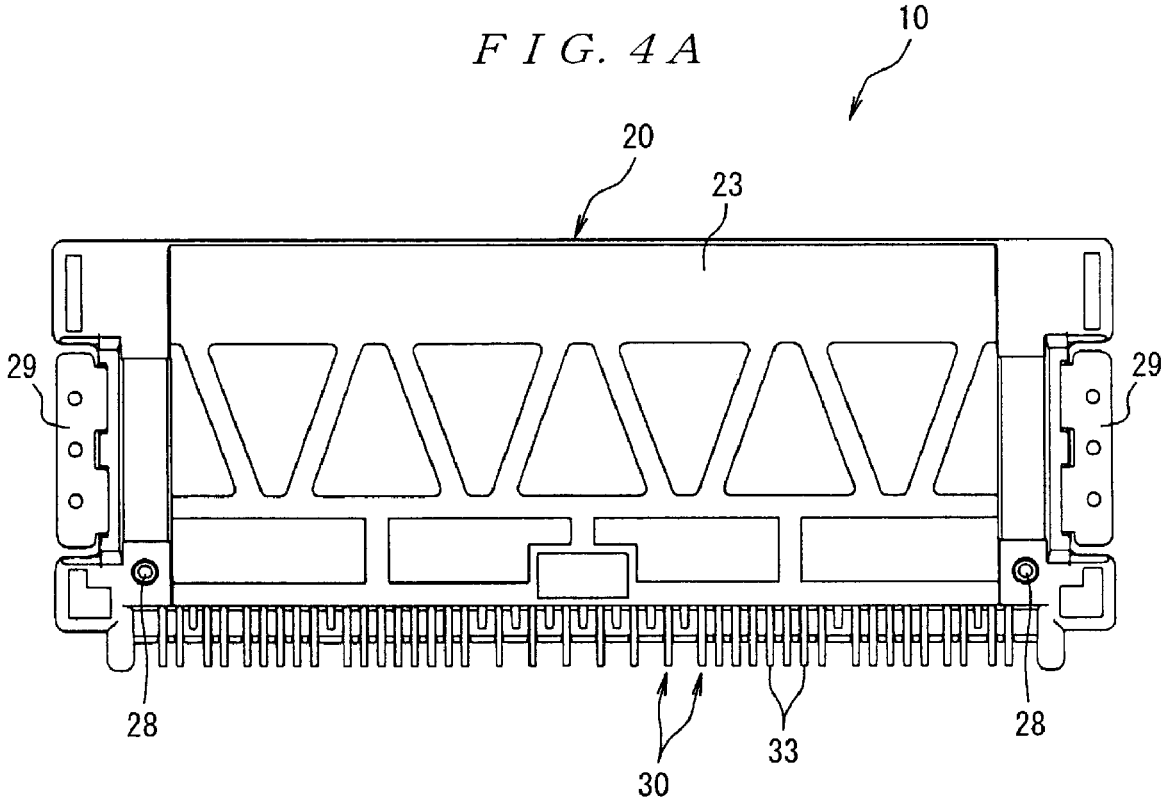
FIG. 4A is an orthogonal view of the first connector of FIG. 1A as seen from below.
Figure 4B:
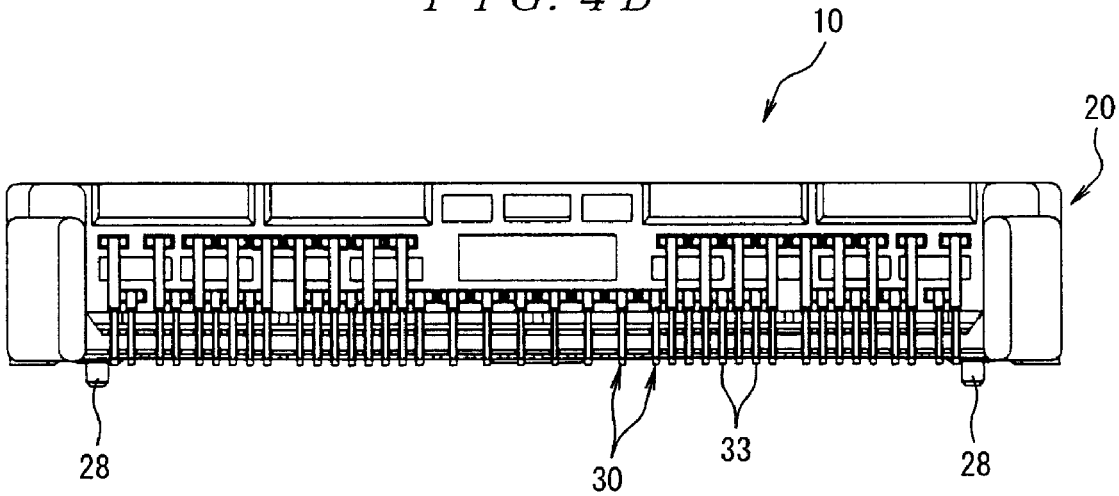
FIG. 4B is an orthogonal view of the first connector of FIG. 1A as seen from the back.

The first connector 10 is constructed to be mounted on a circuit board (not shown in the figures), and comprises a first housing 20 and a plurality of first contacts 30 attached to this first housing 20 in two rows (upper and lower rows). The first housing 20 is formed in a rectangular solid shape extending in the left-right direction (left-right direction in FIG. 3B) by molding an insulating resin. As is shown in FIGS. 1B and 3B, the first housing 20 is provided with a complementary connector receiving concavity 21 that extends in the left-right direction and that is used to receive the complementary connector 40. Furthermore, two projecting ribs 24 that protrude downward are provided in symmetrical positions on either side of the central line CL in the left-right direction on the inside of the upper wall 22 of the first housing 20 located in the upper portion of the complementary connector receiving concavity 21. These two projecting ribs 24 extend rearward from the front surface (lower surface in FIG. 3A) of the first housing 20 (i.e., from the mating surface of the first housing 20 toward the rear in the connector mating direction), and the space between the two projecting ribs 24 demarcates a locking part receiving space 24*a* that receives the locking part 59 of the complementary connector 40. A first locking projection 24*b* that engages with a complementary locking projection 59*a* provided on the locking part 59 is provided on the upper wall 22 located above this locking part receiving space 24*a*.

Figure 5A:
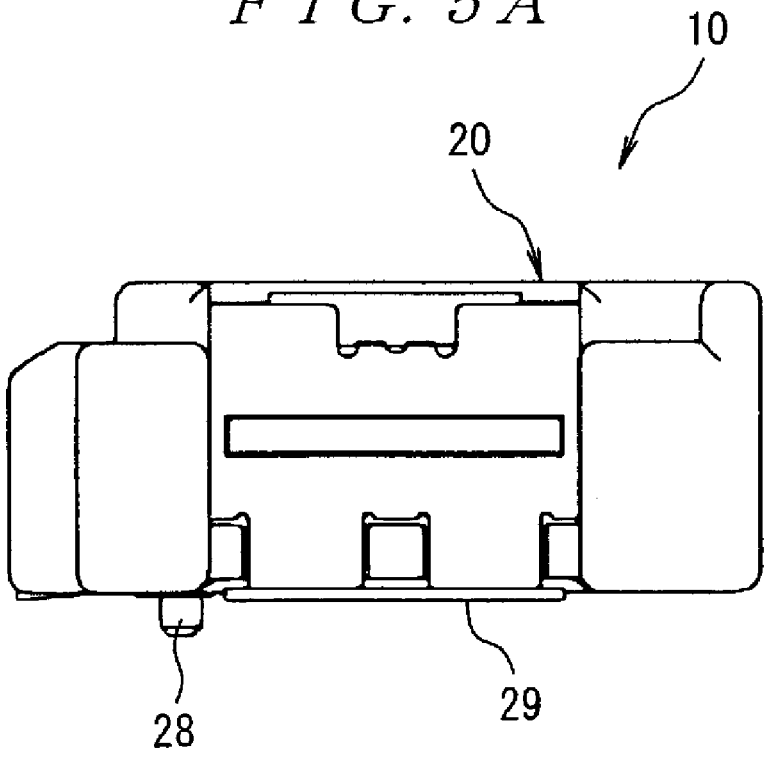
FIG. 5A is an orthogonal view of the first connector of FIG. 1A as seen from the left side.
Figure 5B:
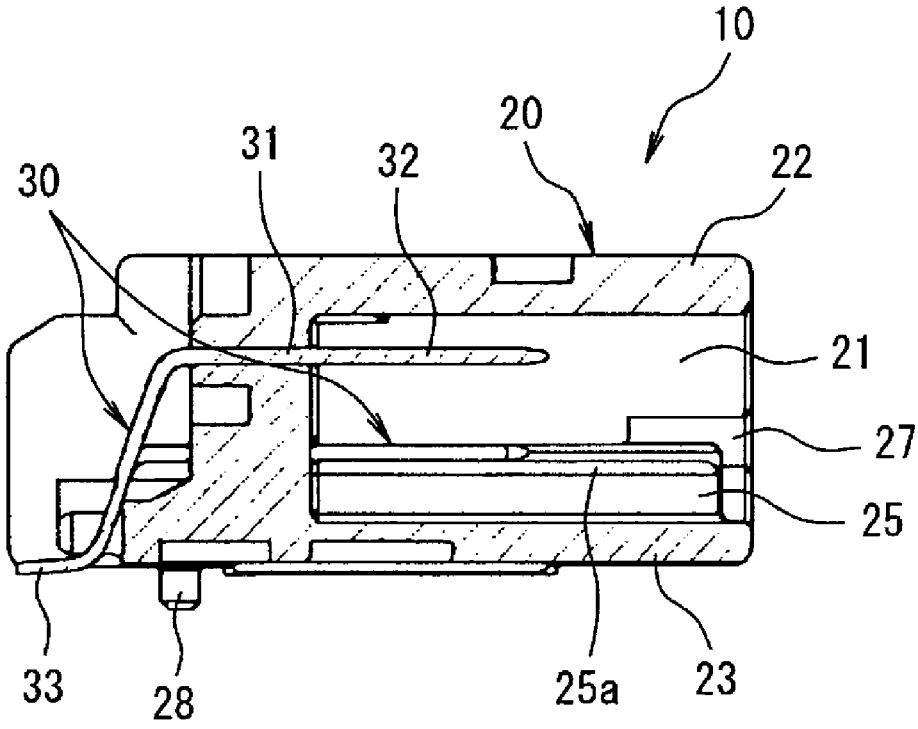
FIG. 5B is an orthogonal cross-sectional view taken along line 5B-5B in FIG. 3B of the first connector of FIG. 1A.

Moreover, as is shown in FIG. 3B, two first connector projections 25 that protrude upward are provided in symmetrical positions on either side of the central line CL in the left-right direction on the inside of the lower wall 23 of the first housing 20 located in the lower portion of the complementary connector receiving concavity 21. These two first connector projections 25 are respectively positioned on the outside of the projecting ribs 24 in the left-right direction. In addition, the respective first connector projections 25 extend rearward from the front surface of the first housing 20 (i.e., from the mating surface of the first housing 20 toward the rear in the connector mating direction) as far as the innermost wall of the complementary connector receiving concavity 21. A protruding part 25*a* that protrudes leftward as seen from the mating surface is provided on the upper portion of the left side surface of each of the first connector projections 25. These protruding parts 25*a* respectively extend in the connector mating direction from the front ends to the rear ends of the individual first connector projections 25 as shown in FIG. 5B. Furthermore, as is shown in FIG. 3B, a first connector concavity 27 is formed on the inside of each of the left side wall 26*a* and right side wall 26*b* of the complementary connector receiving concavity 21 of the first housing 20 slightly toward the bottom in the vertical direction. The first connector concavity 27 formed in the left side wall 26*a* of the complementary connector receiving concavity 21 is recessed toward the left side as seen from the mating surface, i.e., toward the outside of the first housing 20, and extends only for a specified distance from the front surface of the first housing 20 toward the rear (i.e., from the mating surface of the housing 20 toward the rear in the connector mating direction). Likewise, the first connector concavity 27 formed in the right side wall 26*b* of the complementary connector receiving concavity 21 is recessed toward the right side as seen from the mating surface, i.e., toward the outside of the first housing 20, and extends only for a specified distance from the front surface of the first housing 20 toward the rear as shown in FIG. 5B. Moreover, a pair of positioning posts 28 are provided on the undersurface of the lower wall 23 of the first housing 20. In addition, a pair of fastening fittings 29 made of metal for fastening the first connector 10 to the surface of the circuit board are attached with each of these fastening fittings 29 being attached to the outer surfaces of the left side wall 26*a* and right side wall 26*b* of the first housing 20.

Furthermore, as is shown in FIG. 5B, each of the plurality of first contacts 30 attached to the first housing 20 in two rows (upper and lower rows) comprises a fastening part 31 that is press-fitted to the first housing 20, a first contact part 32 that extends forward from the fastening part 31 and that protrudes into the complementary connector receiving concavity 21, and a board connecting part 33 that extends rearward from the fastening part 31 and that protrudes to the outside of the first housing 20. Each contact 30 is formed by stamping and forming a metal plate. The first contact parts 32 are designed to contact upper complementary contacts 91 and lower complementary contacts 95 provided on the complementary connector 40 during the mating between the first connector 10 and complementary connector 40. Here, the first contact parts 32 are formed in a pin shape, so that the first contacts 30 constitute male-type contacts. However, it will be appreciated that in other embodiments, the first contacts 30 may be formed as contacts other than male-type contacts. Moreover, each of the board connecting parts 33 extends rearward from the fastening part 31, is bent downward at an inclination, and is connected to the conductor of the circuit board.

Figure 8:
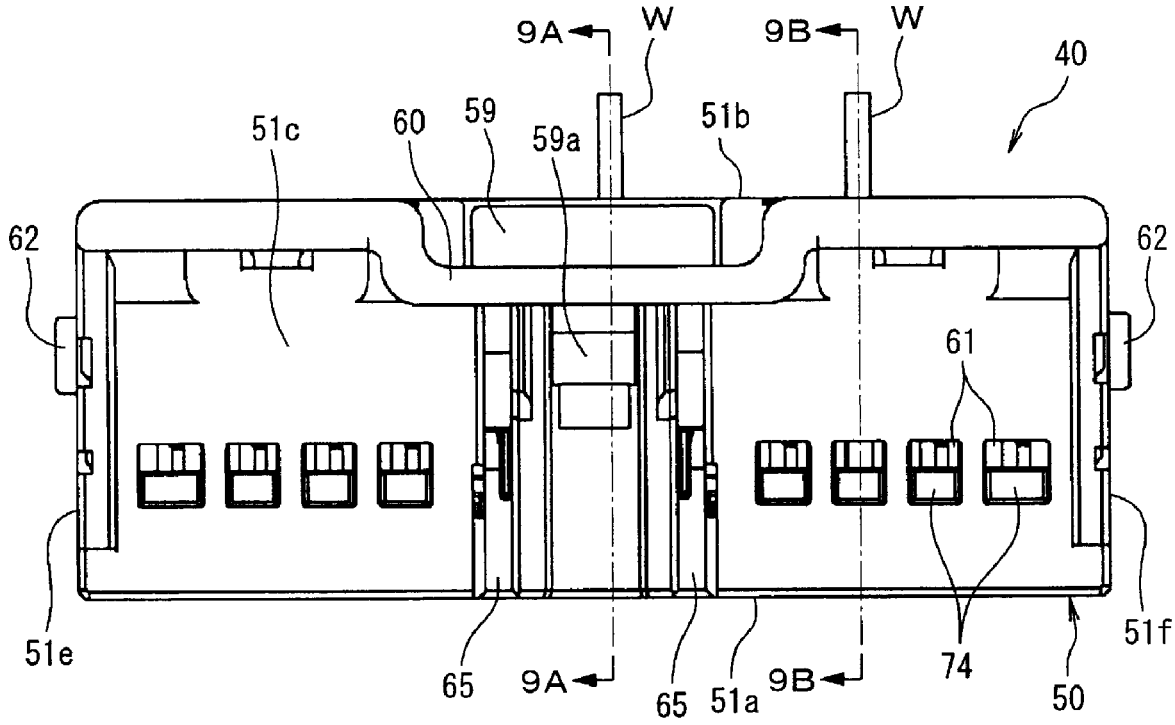
FIG. 8 is an orthogonal view of the complementary connector of FIG. 1A as seen from above.
Figure 9A:
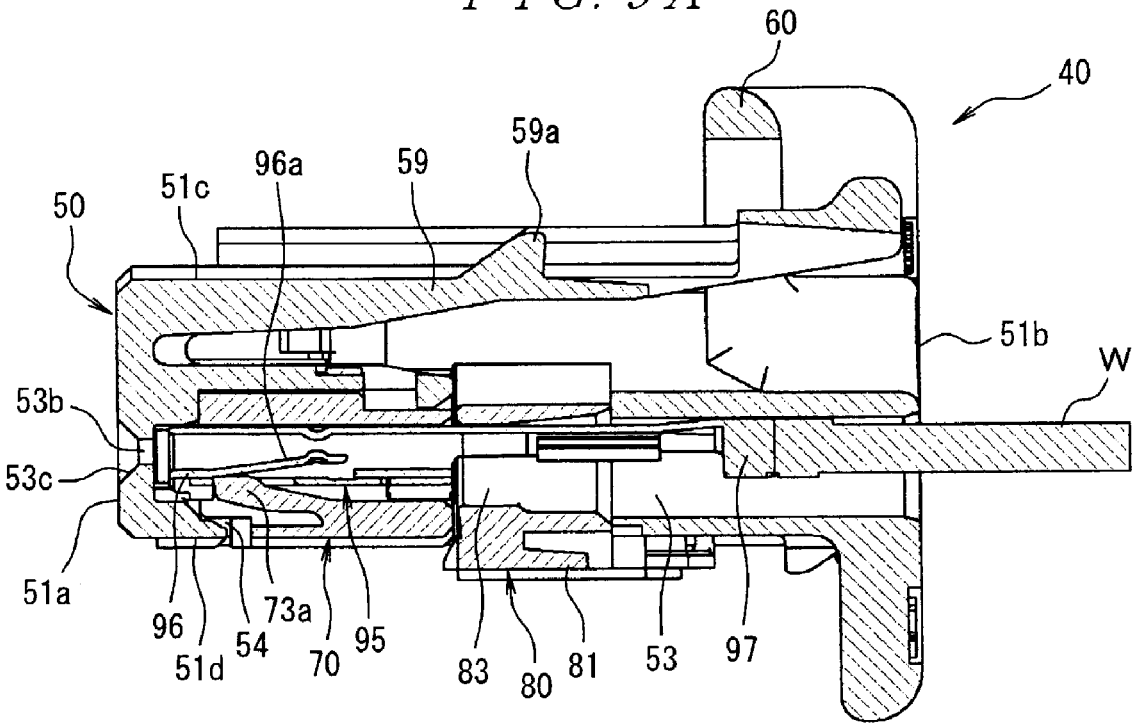
FIG. 9A is a cross-section view taken along line 9A-9A in FIG. 8 of the electrical connector assembly of FIG. 1A showing a state in which the side retainer is in the temporary locking position in the complementary connector.
Figure 9B:
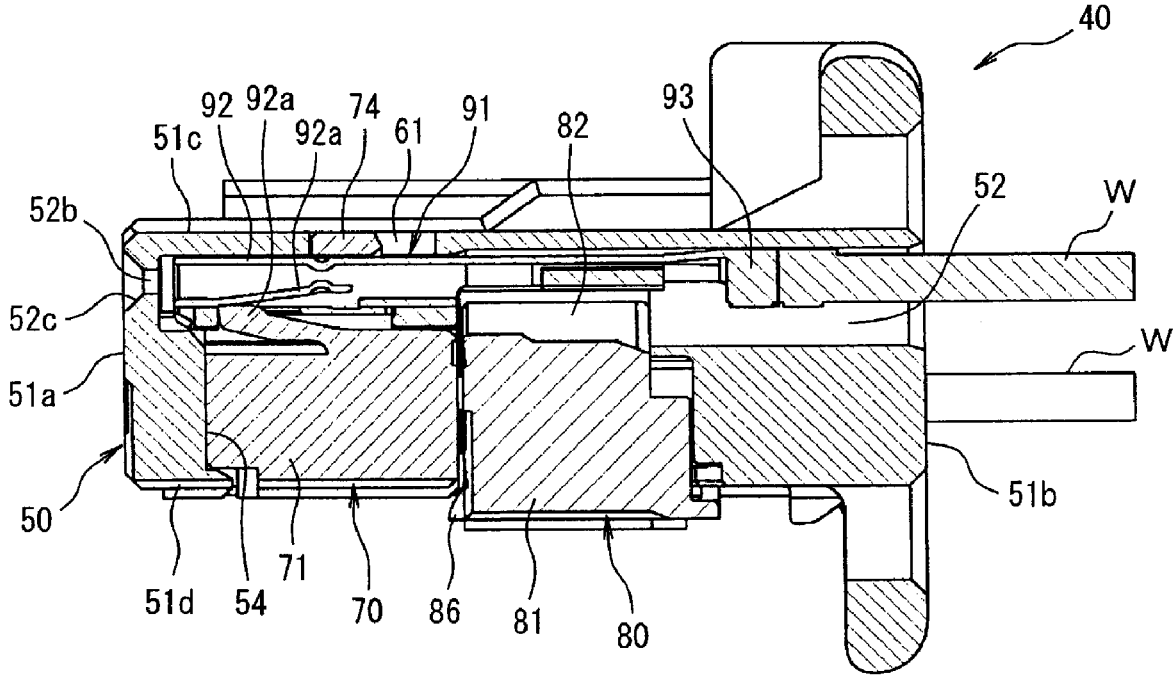
FIG. 9B is a cross-sectional view taken along line 9B-9B in FIG. 8 of the electrical connector assembly of FIG. 1A showing the same state as FIG. 9A.

Next, the complementary connector 40 will be described with reference to FIGS. 6A, 6B, 7A, 7B, 8, 9A, 9B, 10A-10C, 11A, 11B, 12A-12C, 13-15, 16A-16C, 17A and 17B. As is shown in FIGS. 6A, 6B, 7A and 7B, the complementary connector 40 comprises a complementary housing 50, a plurality of upper complementary contacts 91 and lower complementary contacts 95 (see FIGS. 9A, 9B, 11A and 11B) that are accommodated in two rows (upper and lower rows) in the complementary housing 50, a lance block 70, and a side retainer 80. In the following description, the left side and right side in FIG. 8 are respectively referred to as the "left side" and "right side," and the left side, right side, upper side, and lower side in FIGS. 9A and 9B are respectively referred to as the "front side," "rear side," "upper side," and "lower side."

Figure 13:
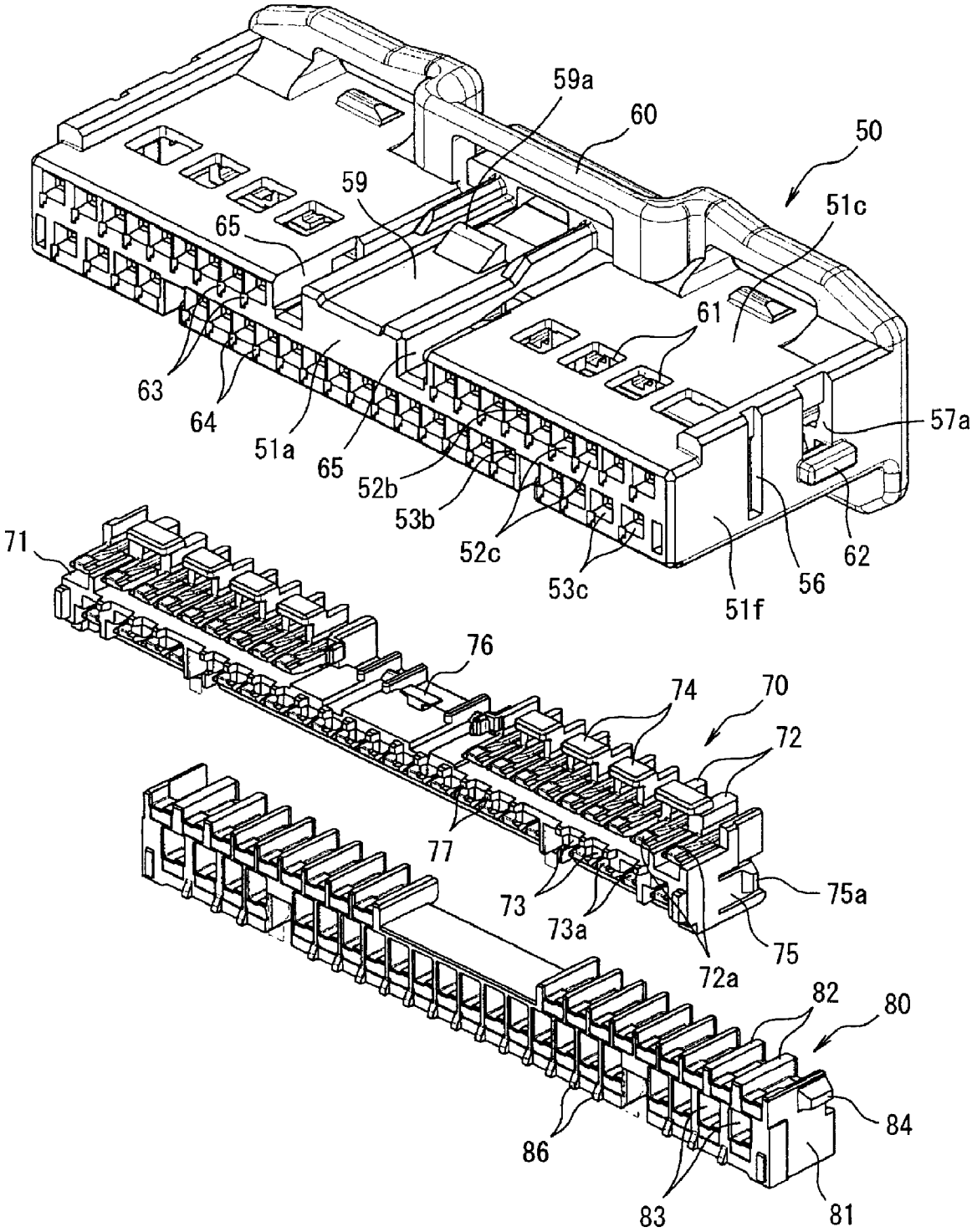
FIG. 13 is an oblique exploded view of the complementary housing, lance block, and side retainer of FIG. 1A as seen from the front and above.
Figure 14:
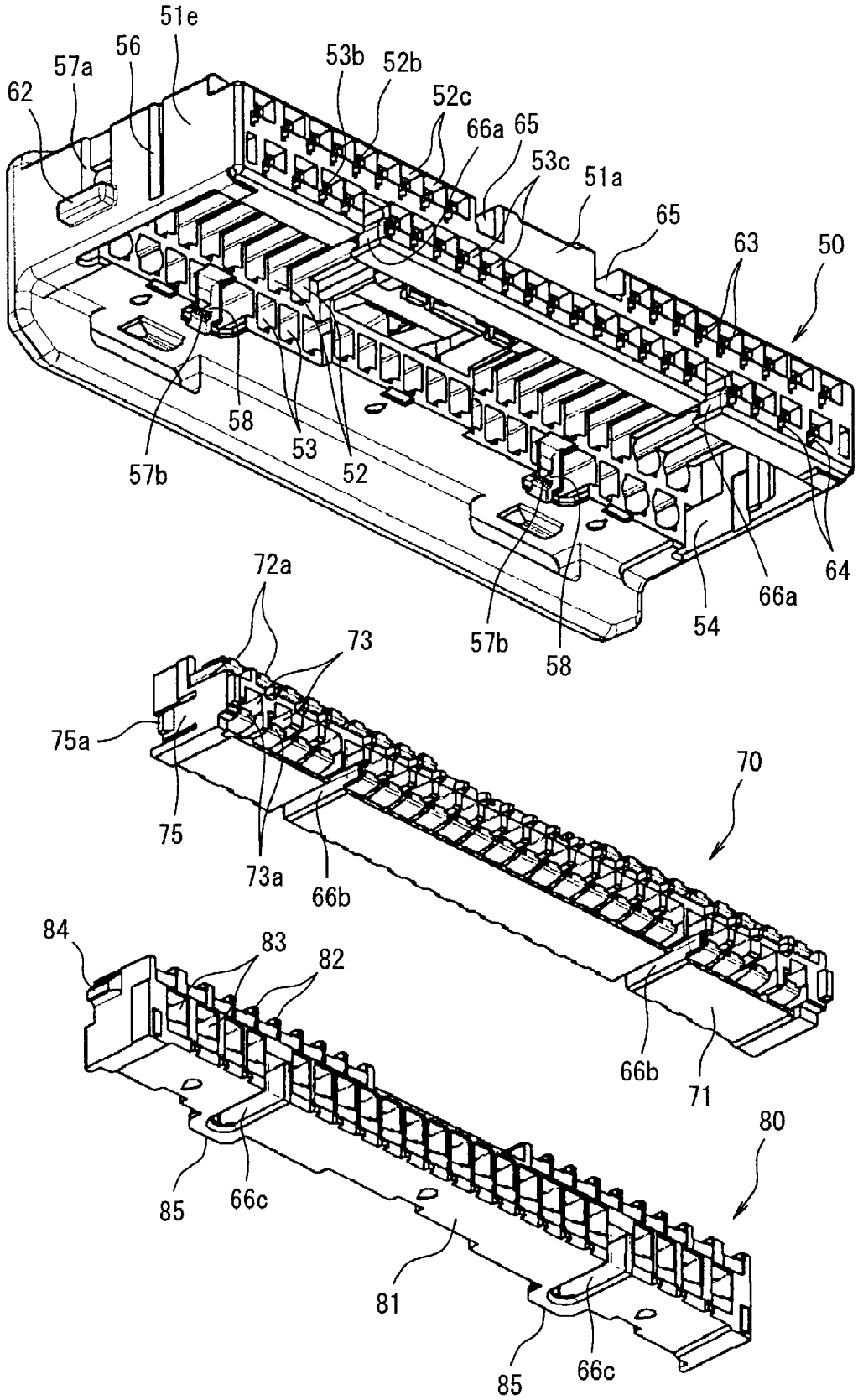
FIG. 14 is an oblique exploded view of the complementary housing, lance block, and side retainer of FIG. 1A as seen from the front and below.
Figure 15:
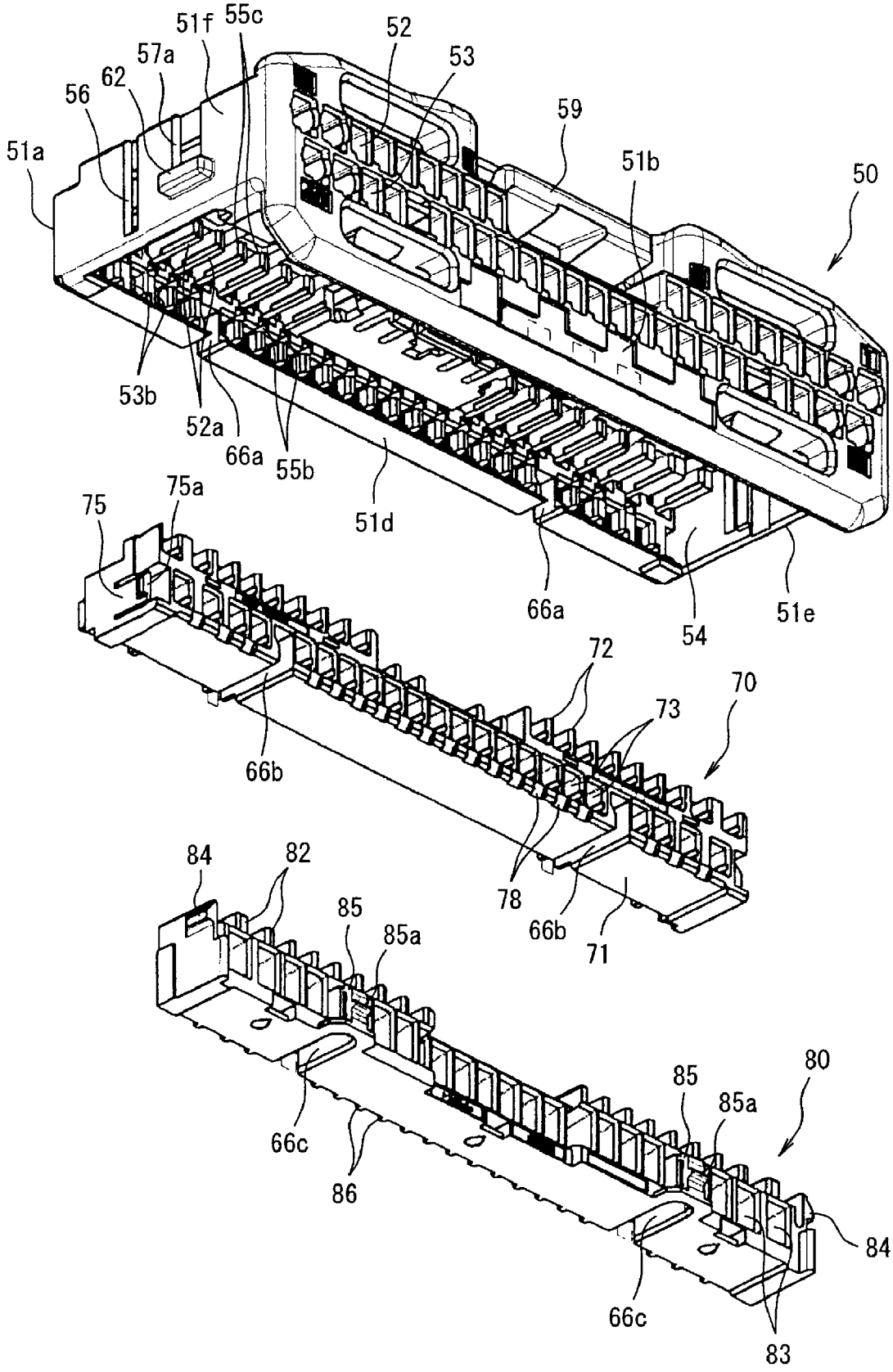
FIG. 15 is an oblique exploded view of the complementary housing, lance block, and side retainer of FIG. 1A as seen from the back and below.
Figure 16A:
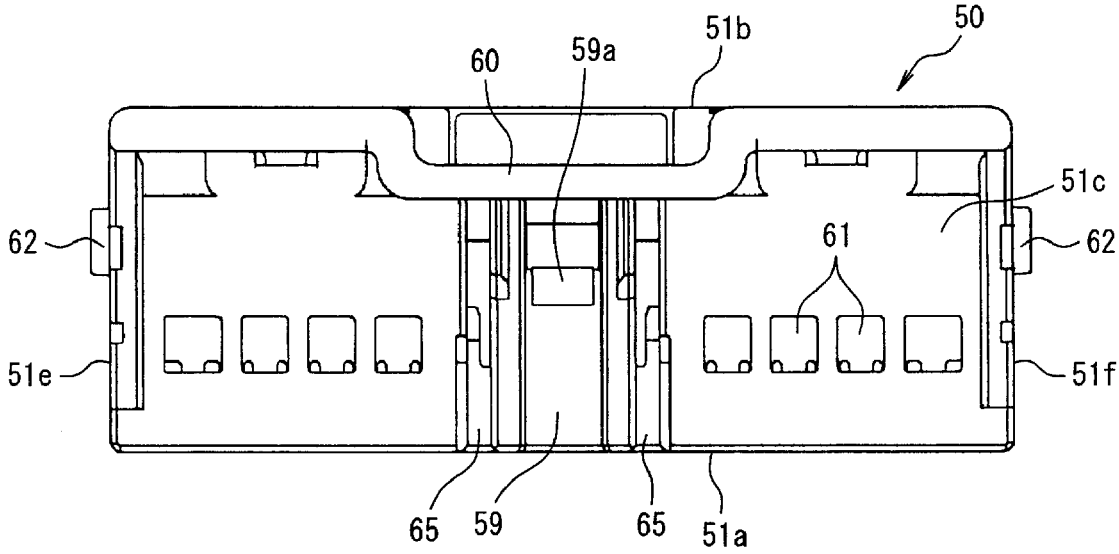
FIG. 16A is an orthogonal top view of the complementary housing of FIG. 1A.
Figure 16B:
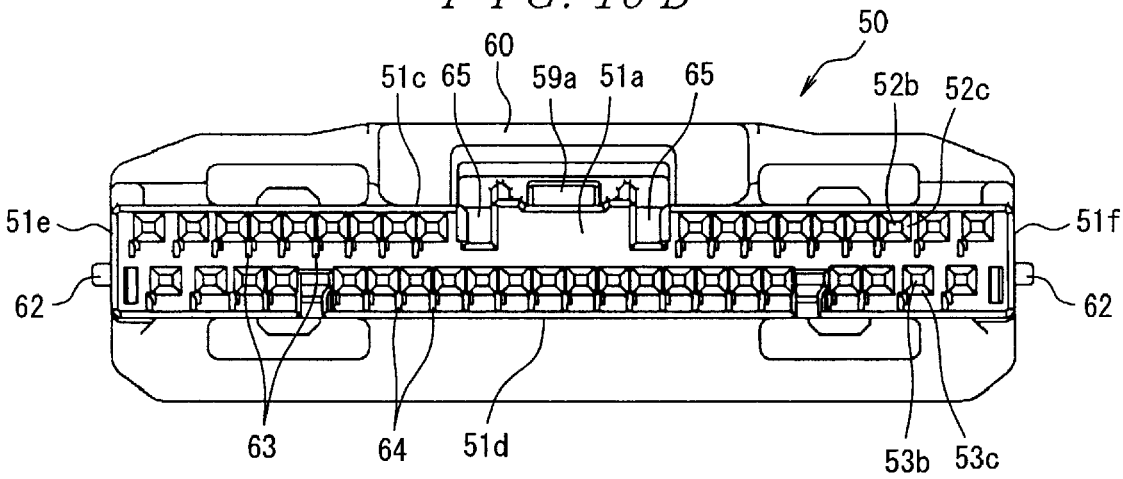
FIG. 16B is an orthogonal front view of the complementary housing of FIG. 1A.
Figure 16C:
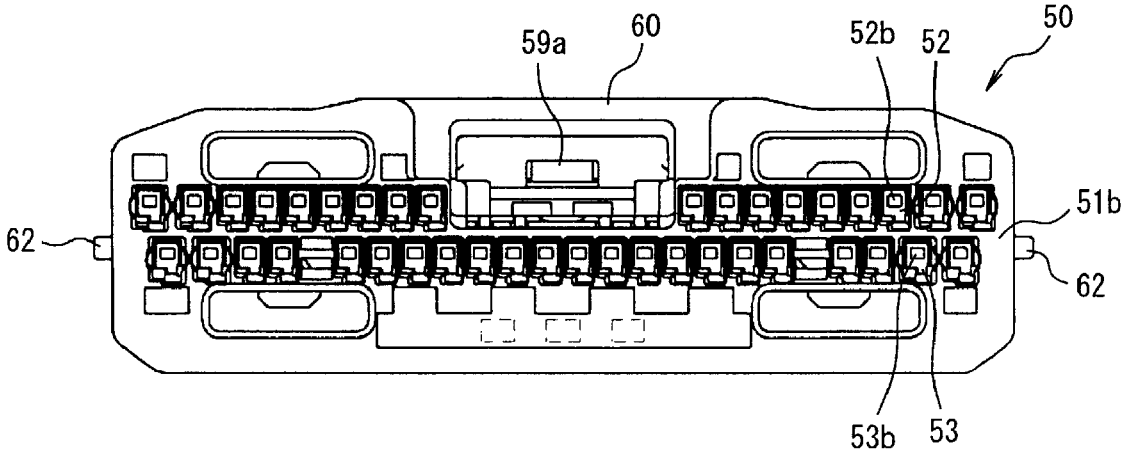
FIG. 16C is an orthogonal back view of the complementary housing of FIG. 1A.

Here, as is shown in FIGS. 16A-16C, 17A and 17B, the complementary housing 50 is formed in a rectangular solid shape extending in the left-right direction and having a front surface 51*a*, a rear surface 51*b*, an upper surface 51*c*, an undersurface 51*d*, a left side surface 51*e*, and a right side surface 51*f*. The complementary housing 50 is designed to be received inside the complementary connector receiving concavity 21 of the first connector 10. The complementary housing 50 is formed by molding an insulating resin such as PBT. Furthermore, as is clearly shown in FIGS. 14 and 15, a concavity 54 is formed substantially in the central portion of the complementary housing 50 in the forward-rearward direction from the undersurface 51*d* of the complementary housing 50 toward the top. Upper contact insertion holes 52 and lower contact insertion holes 53 that are arranged in two rows (upper and lower rows, respectively) at a specified pitch in the left-right direction are formed in the complementary housing 50 in the portion to the rear of the concavity 54. The respective upper contact insertion holes 52 and lower contact insertion holes 53 pass through from the rear surface 51*b* to the concavity 54 of the complementary housing 50. Moreover, first mating contact insertion holes 52*b* and second mating contact insertion holes 53*b* that are arranged in two rows (upper and lower rows, respectively) at a specified pitch in the left-right direction are formed in the complementary housing 50 in the portion to the front of the concavity 54 in positions respectively corresponding to the upper contact insertion holes 52 and lower contact insertion holes 53 in the upper and lower rows. Upper inclined surfaces 52*c* and lower inclined surfaces 53*c* for facilitating the introduction of the first contacts 30 provided on the first connector 10 are respectively formed at the front-end entrances of the individual first mating contact insertion holes 52*b* and second mating contact insertion holes 53*b*. The respective first mating contact insertion holes 52*b* and second mating contact insertion holes 53*b* pass through from the front surface 51*a* to the concavity 54 of the complementary housing 50. In addition, a plurality of first partition walls 52*a* that partition mutually adjacent first mating contact insertion holes 52*b* are provided at the front end of the concavity 54 of the complementary housing 50. The distance between mutually adjacent first partition walls 52*a* is a distance that allows the accommodation of a upper complementary contact 91. Furthermore, as is shown in FIGS. 13, 14, and 16B, a plurality of upper tool insertion holes 63 corresponding to the respective first mating contact insertion holes 52*b* are formed in the front surface 51*a* of the complementary housing 50. Similarly, a plurality of lower tool insertion holes 64 corresponding to the respective second mating contact insertion holes 53*b* are formed in the front surface 51*a* of the complementary housing 50.

Figure 6A:
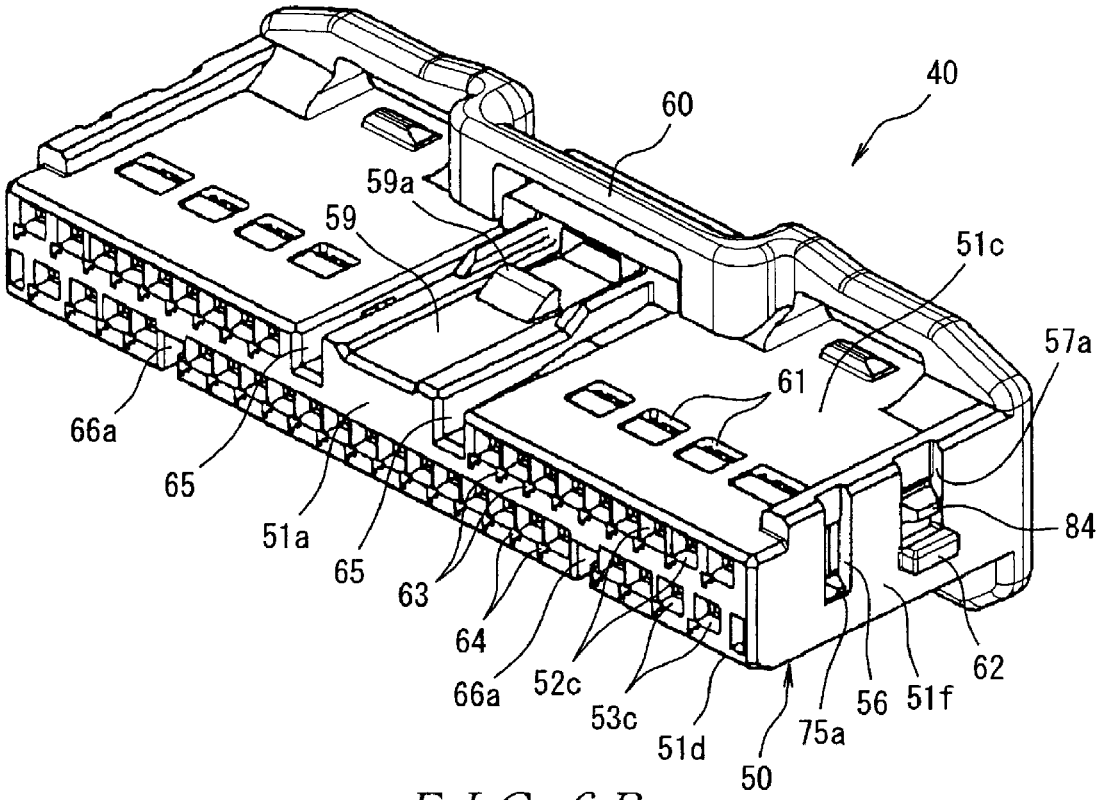
FIG. 6A is an oblique view of a complementary connector of the electrical connector assembly of FIG. 1A as seen from the front and above.
Figure 6B:
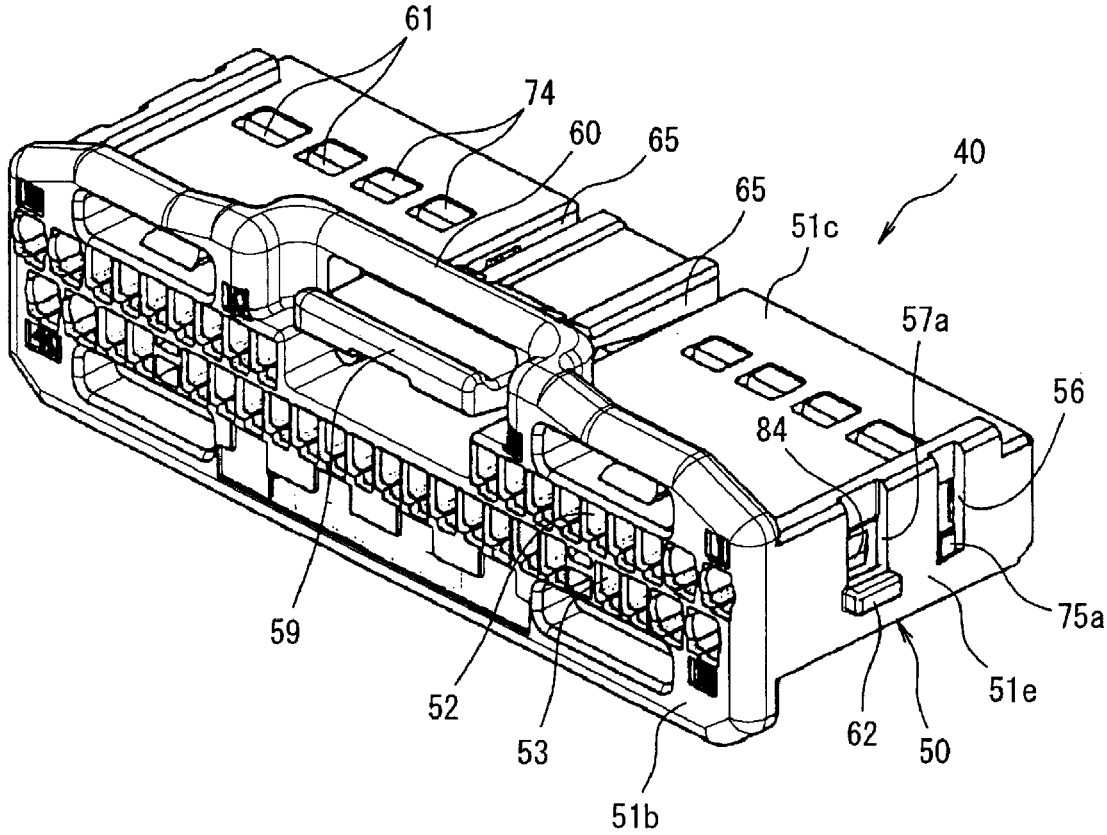
FIG. 6B is an oblique view of the complementary connector of FIG. 1A as seen from the back and above.
Figure 10A:
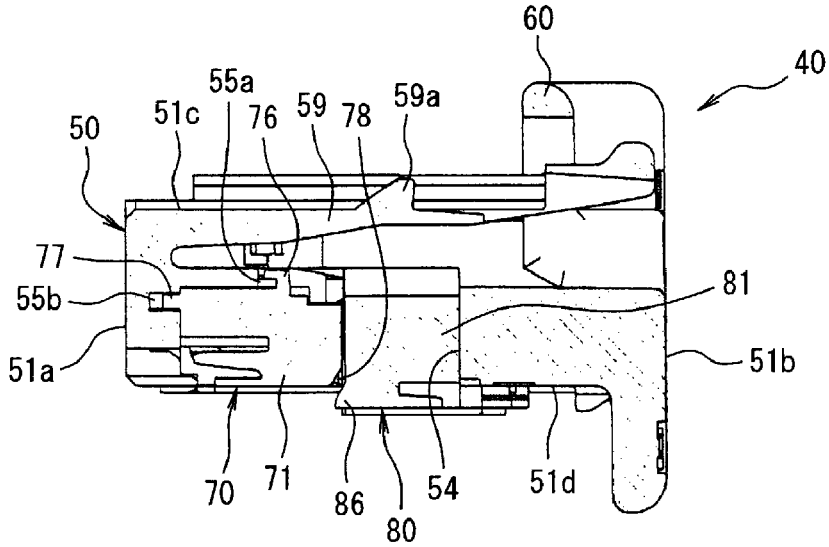
FIG. 10A is a cross-sectional view taken through the positions of both the first positioning projection and a second positioning projection of the lance block of the electrical connector assembly of FIG. 1A in a state in which the side retainer is in the temporary locking position in the complementary connector.
Figure 10B:
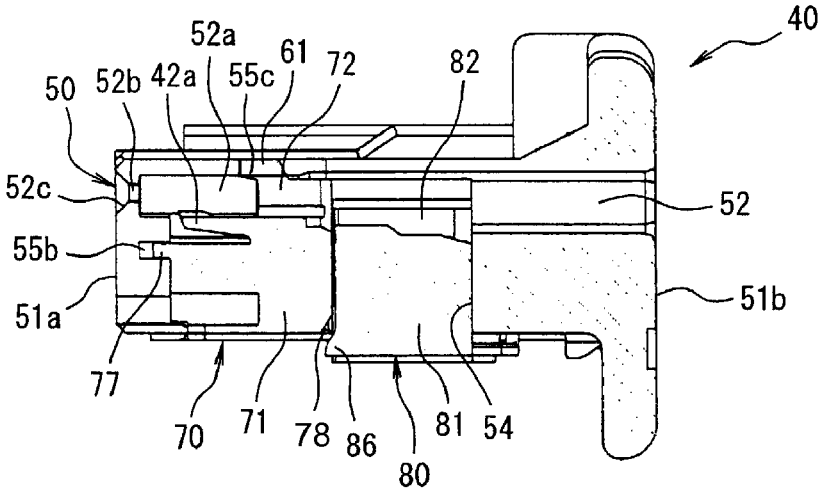
FIG. 10B is a cross-sectional view taken through the positions of both a second positioning projection of the lance block and a first contact insertion hole in the complementary housing of the electrical connector assembly of FIG. 1A in a state in which the side retainer is in the temporary locking position in the complementary connector.
Figure 10C:
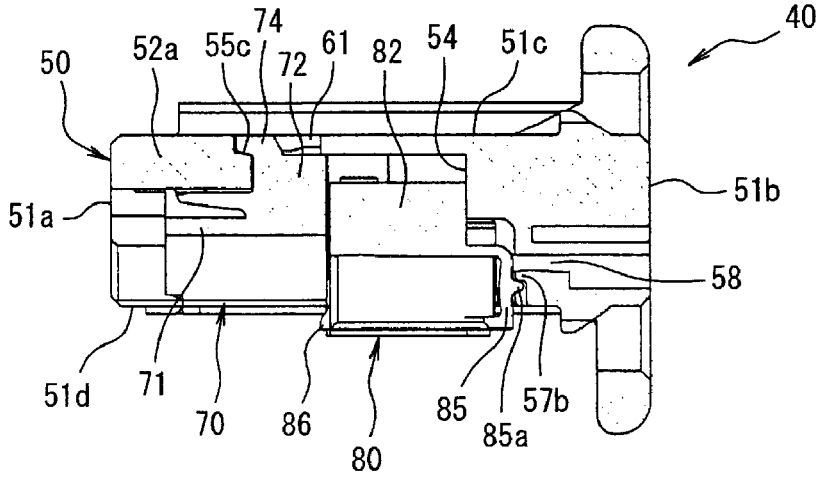
FIG. 10C is a cross-sectional view taken through the positions of both a third positioning projection of the lance block and a main locking projection of the side retainer of the electrical connector assembly of FIG. 1A in a state in which the side retainer is in the temporary locking position in the complementary connector.
Figure 12A:
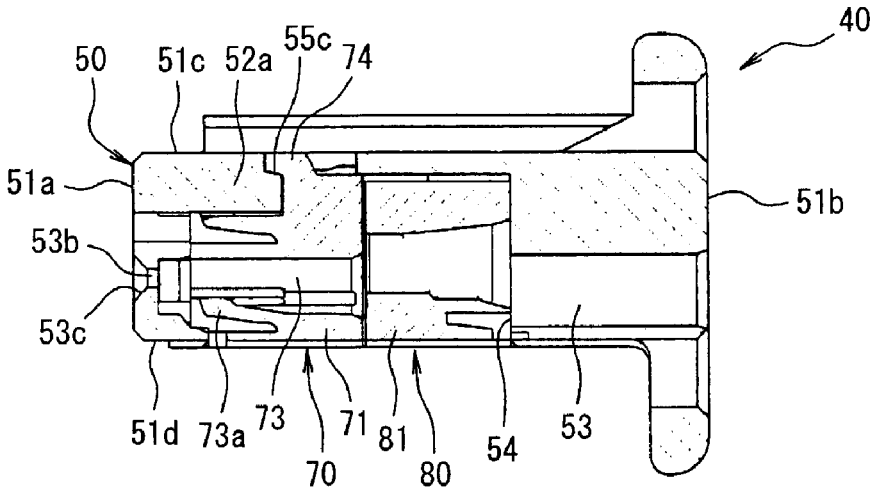
FIG. 12A is a cross-sectional view of the complementary connector of FIG. 1A taken through the positions of both a third positioning projection of the lance block and a second contact insertion hole in the housing and shows a state in which the side retainer is in the main locking position in the complementary connector.
Figure 12B:
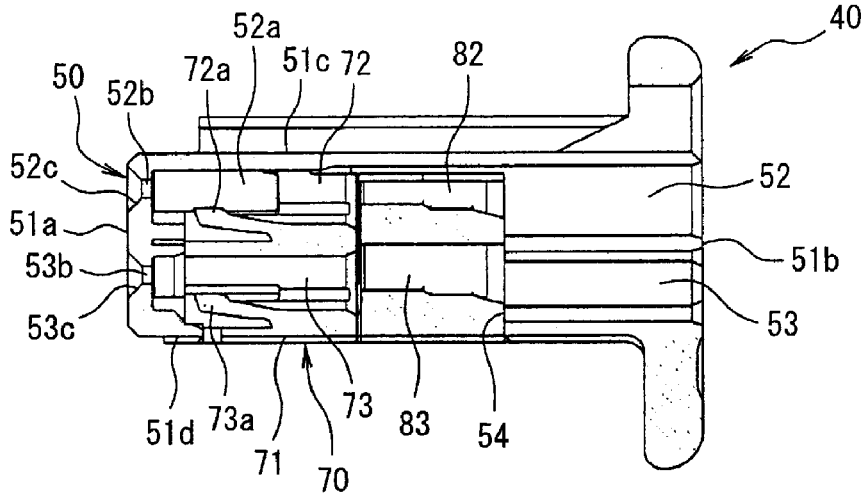
FIG. 12B is a cross-sectional view of the complementary connector of FIG. 1A taken through the positions of both a first contact insertion hole and a second contact insertion hole in the housing and shows a state in which the side retainer is in the main locking position in the complementary connector.
Figure 12C:
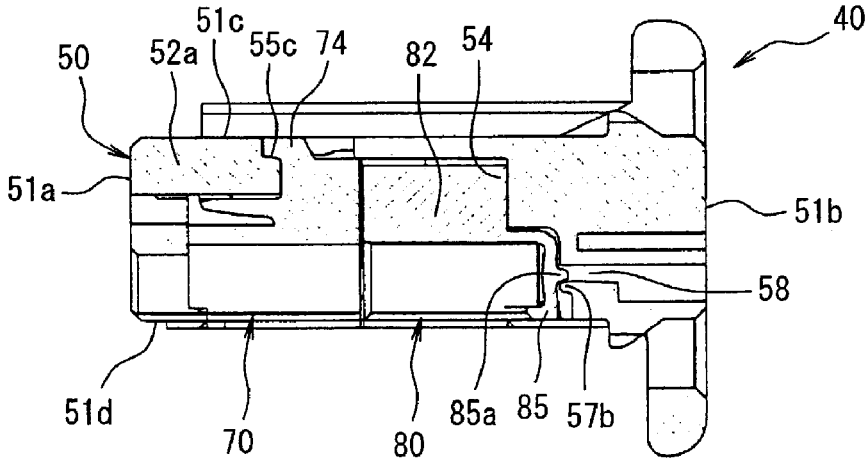
FIG. 12C is a cross-sectional view of the complementary connector of FIG. 1A taken through the positions of both a third positioning projection of the lance block and a main locking projection of the side retainer and shows a state in which the side retainer is in the main locking position in the complementary connector.
Figure 17A:
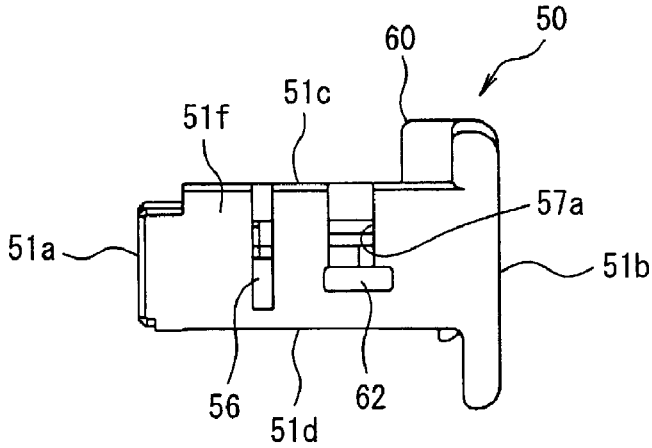
FIG. 17A is an orthogonal right side view of the complementary housing of FIG. 1A.
Figure 17B:
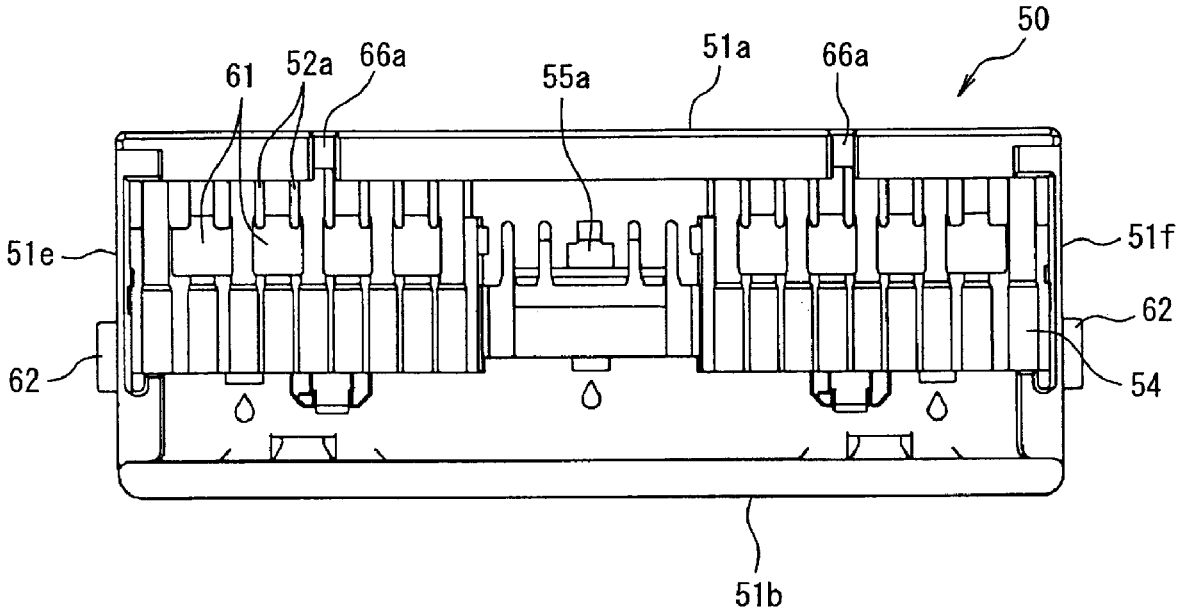
FIG. 17B is an orthogonal bottom view of the complementary housing of FIG. 1A.
Figure 18:
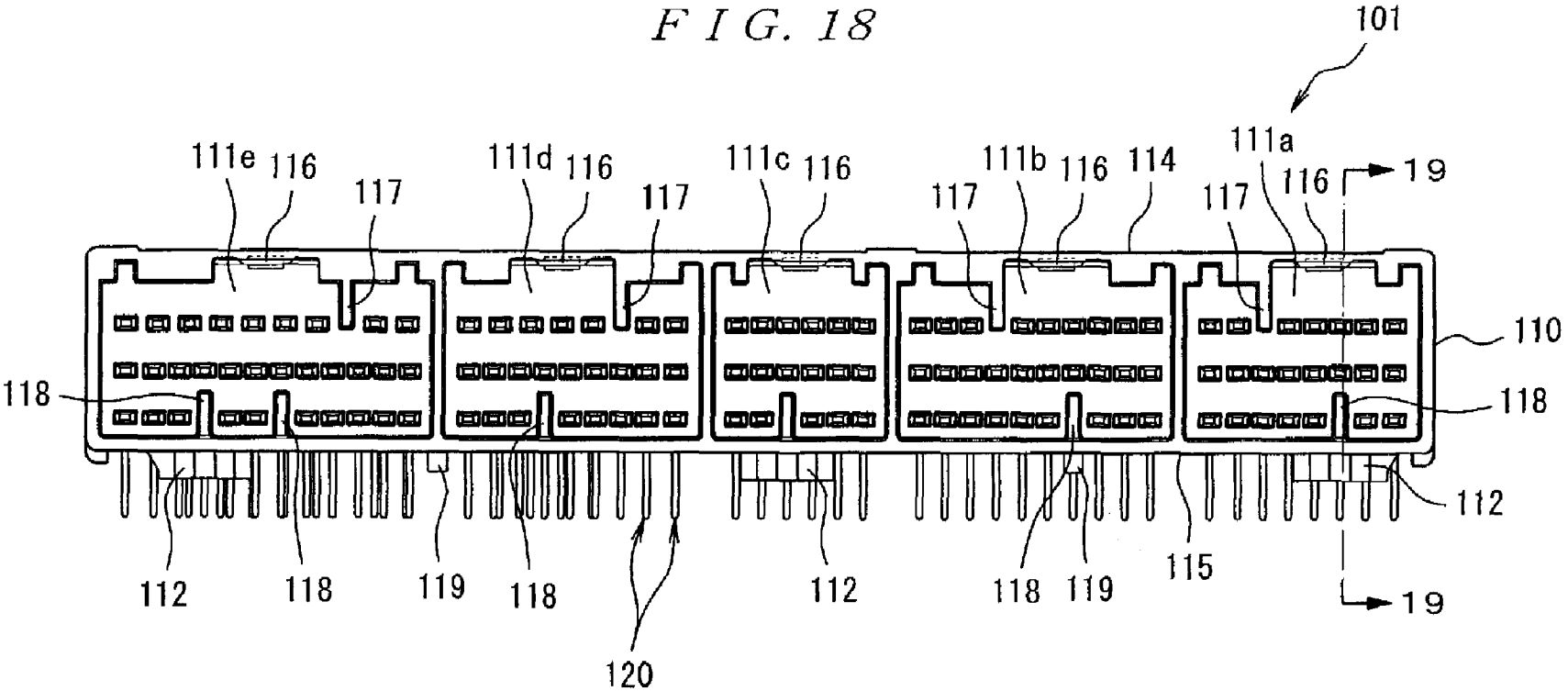
FIG. 18 PRIOR ART
FIG. 18 is a front view of a conventional female-type connector; and Prior Art
Figure 19:
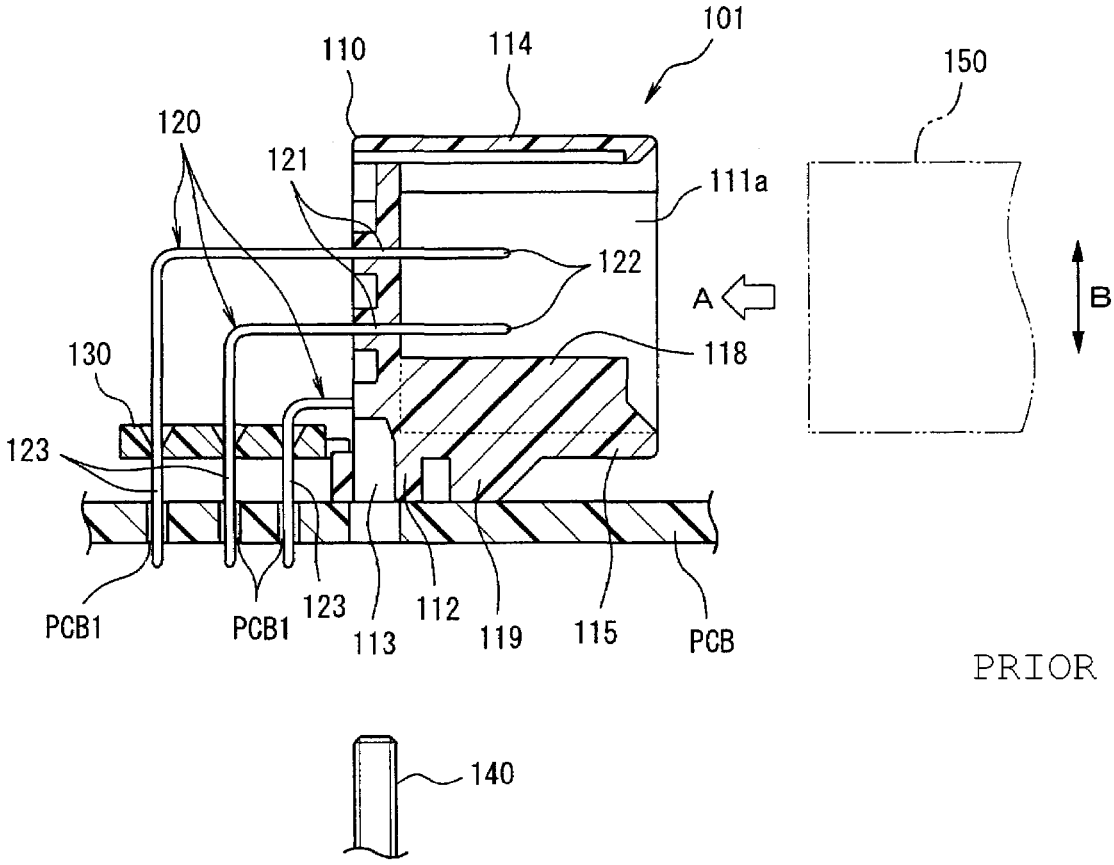
FIG. 19 is a cross-sectional view taken along line 19-19 in FIG. 18 of the conventional connector of FIG. 18.

Moreover, as is shown in FIGS. 10A and 17B, a first positioning projection concavity 55*a* into which the first positioning projection 76 of the lance block 70 is inserted is formed in the upper surface of the concavity 54 of the complementary housing 50, and a plurality of second positioning projection concavities 55*b* into which second positioning projections 77 of the lance block 70 are inserted are formed in the front end surface of the concavity 54 as shown in FIGS. 10A, 10B, and 15. In addition, as is shown in FIGS. 8, 9B, and 10C, a plurality of openings 61 into which third positioning projections 74 of the lance block 70 are inserted are formed in the upper surface 51*c* of the complementary housing 50 so that these openings 61 pass through to the concavity 54, and shoulder parts 55*c* with which the third positioning projections 74 engage are respectively formed in the upper edge portions of the first partition walls 52*a* facing these openings 61. Furthermore, locking projection openings 56 into which the locking catches 75*a* of the lance block 70 are inserted are respectively formed in the left side surface 51*e* and right side surface 5 if of the complementary housing 50. Moreover, as is shown in FIGS. 6A and 6B, temporary locking projection openings 57*a* into which temporary locking projections 84 of the side retainer 80 are inserted are respectively formed in the left side surface 51*e* and right side surface 5 if of the complementary housing 50, and as is shown in FIGS. 10C and 14, a plurality of tabs 57*b* with which the main locking projections 85*a* of the side retainer 80 make contact from below are formed on the rear end surface of the concavity 54 of the housing 50. In addition, as is shown in FIGS. 12C and 14, slits 58 into which the main locking projections 85*a* of the side retainer 80 are inserted pass through to the rear end surface of the complementary housing 50 in the rear end surface of the concavity 54 of the complementary housing 50 above the tabs 57*b*. Furthermore, a locking part 59 for locking the first connector 10 when the first connector 10 mates is provided on the upper surface 51*c* of the complementary housing 50, and a complementary locking projection 59*a* is provided on this locking part 59 substantially in the central portion in the forward-rearward direction. This complementary locking projection 59*a* is designed to engage with the first locking projection 24*b* of the first connector 10. Moreover, a protection part 60 for protecting this locking part 59 is provided on the upper surface 51*c* of the complementary housing 50.

Figure 7A:
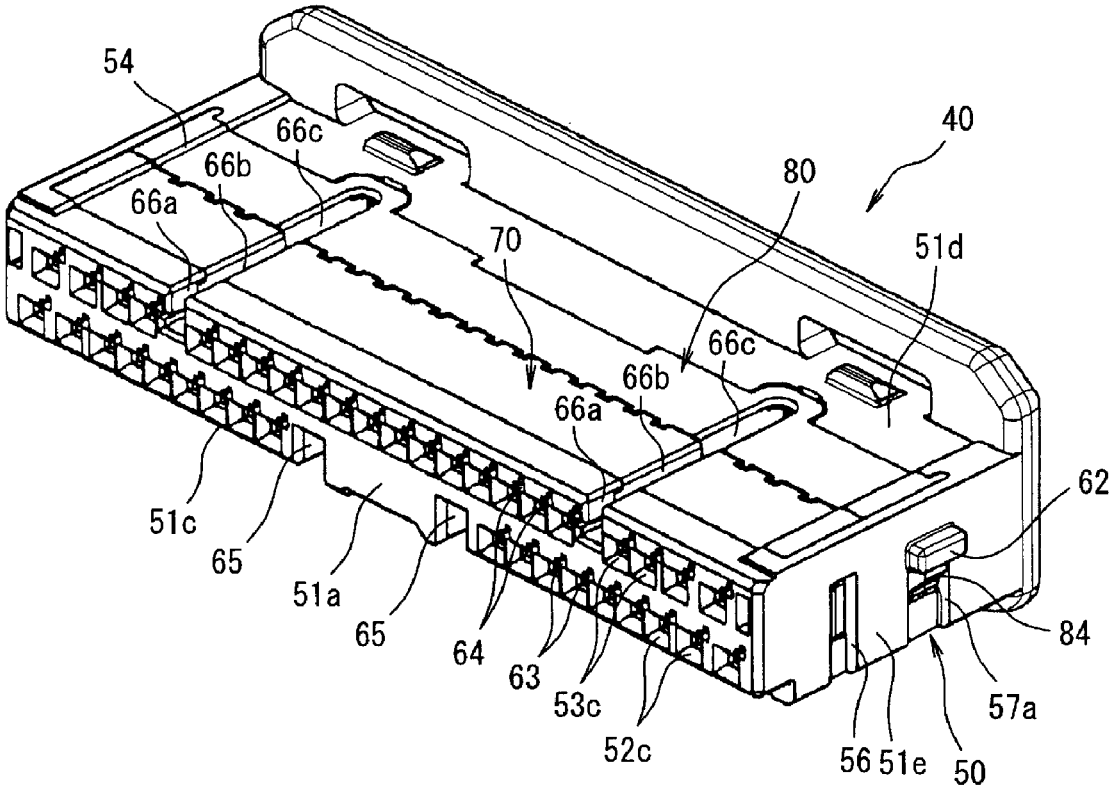
FIG. 7A is an oblique view of an undersurface the complementary connector of FIG. 1A as seen from the front and above.
Figure 7B:
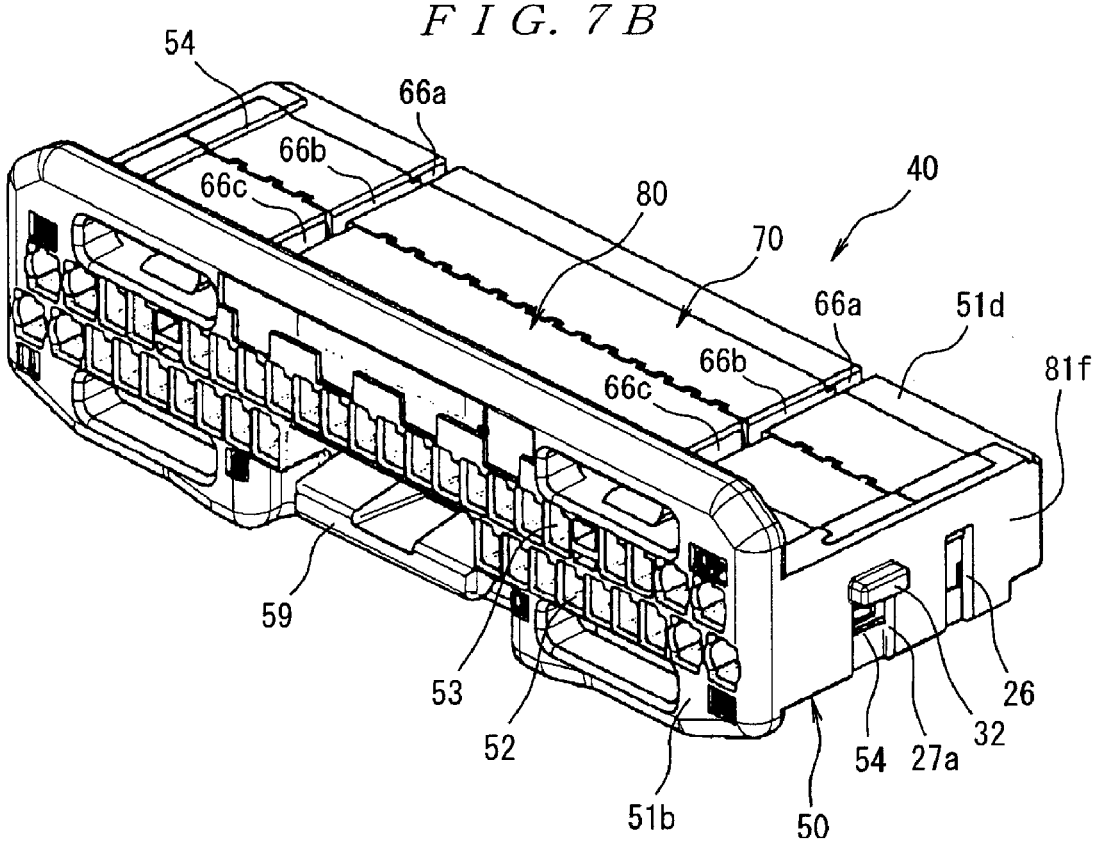
FIG. 7B is an oblique view of an undersurface the complementary connector of FIG. 1A as seen from the back and above.

In addition, as is shown in FIGS. 7A and 7B, two first grooves 66*a* that have a cross-sectional shape that is complementary to the cross-sectional shape of the first connector projections 25 of the first connector 10 are formed in the undersurface 51*d* of the complementary housing 50. The respective first grooves 66*a* are formed in positions where the first connector projections 25 of the first connector 10 are fitted in the left-right direction of the complementary housing 50. Furthermore, the respective first grooves 66*a* extend from the front surface 51*a* of the complementary housing 50 toward the rear (i.e., from the front surface 51*a* of the complementary housing 50 toward the rear in the connector mating direction) as far as the concavity 54. Moreover, as is shown in FIGS. 6A and 6B, side projections 62 that have a cross-sectional shape that is complementary to the cross-sectional shape of the first connector concavities 27 of the first connector 10 are respectively provided on the left side surface 51*e* and right side surface 51*f* of the complementary housing 50. The respective side projections 62 extend in the connector mating direction in the lower portion of the temporary locking projection openings 57*a*. The respective side projections 62 are provided in positions where these side projections 62 are received by the first connector concavities 27 of the first connector 10 in the vertical direction.

Next, the respective upper complementary contacts 91 are designed to be accommodated in the concavity 54 of the complementary housing 50 by passing through the upper contact insertion holes 52 in the upper row from the side of the rear surface of the complementary housing 50 as shown in FIG. 9B. Each of the upper complementary contacts 91 is constructed as a female-type contact, and comprises a substantially box-form upper contact part 92 that receives the first contact part 32 of one of the first contacts 30 provided on the first connector 10 and contacts this first contact part 32, and an upper electrical wire connecting part 93 that extends rearward from the upper contact part 92 and that is connected to one of the electrical wires W. However, it will be appreciated that in other embodiments the upper complementary contacts 91 may not be formed as female-type contacts. An elastic contact piece 92*a* that contacts the first contact part 32 of one of the first contacts 30 is provided on each upper contact part 92. Each of the upper complementary contacts 91 is formed by stamping and forming a metal plate.

Furthermore, as is shown in FIG. 9A, the respective lower complementary contacts 95 are designed to be accommodated in the concavity 54 of the complementary housing 50 by passing through the lower contact insertion holes 53 in the lower row from the side of the rear surface of the complementary housing 50. As is the case with each upper complementary contact 91, each of the lower complementary contacts 95 is constructed as a female-type contact, and comprises a substantially box-form lower contact part 96 that receives the first contact part 32 of one of the first contacts 30 provided on the first connector 10 and contacts this first contact part 32, and a lower electrical wire connecting part 97 that extends rearward from the lower contact part 96 and that is connected to one of the electrical wires W. However, it will be appreciated that in other embodiments the lower complementary contacts 95 may not be formed as female-type contacts. As is the case with the upper contact part 92 of each upper complementary contact 91, an elastic contact piece 96*a* that contacts the first contact part 32 of one of the first contacts 30 is provided on each lower contact part 96. Each of the lower complementary contacts 95 is formed by stamping and forming a metal plate.

Moreover, as is shown in FIGS. 9A, 9B, 10A-10C, 11A, 11B, and 12A-12C, the lance block 70 is accommodated in the concavity 54 of the complementary housing 50 by being inserted from the side of the undersurface, so that the primary locking of the upper complementary contacts 91 and lower complementary contacts 95 is accomplished. As is shown in FIGS. 13-15, this lance block 70 comprises a lance block base 71 that extends in the left-right direction in dimensions that allow accommodation into the concavity 54 of the complementary housing 50. The lance block 70 is formed by molding an insulating resin. The lance block base 71 is provided with a plurality of lance block through-holes 73 that are arranged in the left-right direction at the same pitch as the lower contact insertion holes 53 and second mating contact insertion holes 53*b* in the lower row of the complementary housing 50. The width of each of the lance block through-holes 73 is a width that allows the insertion of a lower complementary contact 95. Lower elastic lances 73*a* for the primary locking of the lower complementary contacts 95 are provided in the respective lance block through-holes 73. Furthermore, a plurality of second partition walls 72 that are aligned in the left-right direction and vertical direction with the first partition walls 52*a* provided on the complementary housing 50 when the lance block 70 is accommodated in the concavity 54 are provided above the lance block through-holes 73 of the lance block base 71. The distance between mutually adjacent second partition walls 72 is a distance that allows the insertion of a first contact 91. The upper elastic lances 72*a* for the primary locking of the upper complementary contacts 91 are respectively provided between mutually adjacent second partition walls 72.

In addition, as is shown in FIG. 13, third positioning projections 74 are respectively provided on the upper ends of mutually adjacent second partition walls 72 in a shape that links the two upper ends. The third positioning projections 74 position the lance block 70 in the left-right direction by entering the openings 61 formed in the upper surface 51*c* of the complementary housing 50, and also restrict the downward movement of the lance block 70 by contacting the shoulder parts 55*c* formed on the upper edge portions of the first partition walls 52*a* of the complementary housing 50. Furthermore, as is shown in FIGS. 13 and 14, a pair of elastic tongue parts 75 that extend rearward are provided with each of these tongue parts being provided on the left side surface and right side surface of the lance block base 71, and as is shown in FIGS. 6A and 6B, the locking catches 75*a* that enter the locking projection openings 56 in the complementary housing 50 are provided on the rear ends of the respective elastic tongue parts 75. The locking catches 75*a* restrict the movement of the lance block 70 in the forward-rearward direction by entering the locking projection openings 56 in the complementary housing 50. Moreover, the first positioning projection 76 that enters the first positioning projection concavity 55*a* formed in the complementary housing 50 is provided on the upper surface of the lance block base 71. The first positioning projection 76 restricts the forward and upward movement of the lance block 70 by entering the first positioning projection concavity 55*a*. In addition, a plurality of second positioning projections 77 that enter the second positioning projection concavities 55*b* formed in the complementary housing 50 are provided on the front surface of the lance block base 71. The second positioning projections 77 restrict the movement of the lance block 70 in the vertical direction by entering the second positioning projection concavities 55*b*. Furthermore, as is shown in FIGS. 10B and 15, a plurality of sloped walls 78 that are pressed by pressing projections 86 of the side retainer 80 are formed at the lower corner edge of the rear surface of the lance block base 71.

Moreover, as is shown in FIGS. 7A, 7B, 14, and 15, two second grooves 66*b* that have a cross-sectional shape that is complementary to the cross-sectional shape of the first connector projections 25 of the first connector 10 are formed in the undersurface of the lance block base 71 of the lance block 70. The respective second grooves 66*b* are formed in positions where the first connector projections 25 of the first connector 10 are fitted in the left-right direction of the lance block base 71. Furthermore, the respective second grooves 66*b* extend from the front surface of the lance block base 71 toward the rear (i.e., toward the rear in the connector mating direction) as far as the rear surface.

In addition, as is shown in FIGS. 9A, 9B, 10A-10C, 11A, 11B, 12A-12C, the side retainer 80 is accommodated in the concavity 54 of the complementary housing 50 by being inserted from the undersurface side, so that the secondary locking of the upper complementary contacts 91 and lower complementary contacts 95 is accomplished. The side retainer 80 moves from the temporary locking position shown in FIGS. 9A, 9B, and 10A-10C to the main locking position shown in FIGS. 11A, 11B, and 12A-12C. The side retainer 80 performs the secondary locking of the upper complementary contacts 91 and lower complementary contacts 95 when located in the main locking position. The side retainer 80 comprises a side retainer base 81 that extends in the left-right direction in dimensions that allow accommodation in the concavity 54 of the complementary housing 50 as shown in FIGS. 13-15. The side retainer 80 is formed by molding an insulating resin. A plurality of side retainer through-holes 83 that are arranged in the left-right direction at the same pitch as the second contact insertion holes 53 and second mating contact insertion holes 53*b* of the complementary housing 50 are formed in the side retainer base 81. The width of each of the side retainer through-holes 83 is a width that allows the insertion of a lower complementary contact 95. Furthermore, a plurality of third partition walls 82 that are aligned in the left-right direction and vertical direction with the second partition walls 72 provided on the lance block 70 when the side retainer 80 is accommodated in the concavity 54 of the complementary housing 50 are provided above the side retainer through-holes 83 of the side retainer base 81. The distance between mutually adjacent third partition walls 82 is a distance that allows the insertion of a upper complementary contact 91.

Moreover, as is shown in FIGS. 6A, 6B, and 13-15, a pair of temporary locking projections 84 that enter the temporary locking projection openings 57*a* formed in the complementary housing 50 are provided with each of these temporary locking projections being provided on the left side surface and right side surface of the side retainer base 81. The respective temporary locking projections 84 restrict the downward movement of the side retainer 80 by engaging with the lower edge portions of the temporary locking projection openings 57*a* in the temporary locking position shown in FIGS. 9A, 9B, and 10A-10C. Furthermore, a plurality of elastic parts 85 that protrude rearward are provided on the rear surface of the side retainer base 81, and a main locking projection 85*a* that protrudes rearward is provided on each of the elastic parts 85. The respective main locking projections 85*a* restrict the upward movement of the side retainer 80 by contacting the tabs 57*b* of the complementary housing 50 from below in the temporary locking position shown in FIG. 10C. Moreover, the respective main locking projections 85*a* restrict the movement of the side retainer 80 in the vertical direction by entering the slits 58 of the complementary housing 50 in the main locking position shown in FIG. 12C. In addition, a plurality of pressing projections 86 that press the sloped walls 78 formed on the lance block 70 when the side retainer 80 is in the main locking position are formed on the front surface of the side retainer base 81. As a result, the side retainer 80 presses the lance block 70 in the forward direction, thus fastening this lance block 70 to the complementary housing 50.

Furthermore, as is shown in FIGS. 7A, 7B, 14 and 15, two third grooves 66*c* that have a cross-sectional shape that is complementary to the cross-sectional shape of the first connector projections 25 of the first connector 10 are formed in the undersurface of the side retainer base 81 of the side retainer 80. The respective third grooves 66*c* are formed in positions where the first connector projections 25 of the first connector 10 are fitted in the left-right direction of the base part 81 when the side retainer 80 is in the main locking position. Moreover, the respective third grooves 66*c* extend from the front surface of the side retainer base 81 toward the rear (i.e., toward the rear in the connector mating direction).

Next, an assembly method of the complementary connector 40 will be described. First, in the state shown in FIGS. 13-15, and 16A-16C, the lance block 70 is accommodated inside the concavity 54 of the complementary housing 50 by being inserted from the side of the undersurface of the complementary housing 50. In this case, the lance block 70 is inserted into the concavity 54 from the side of the undersurface of the complementary housing 50, and this lance block 70 is moved in the forward direction, so that the lance block 70 is fastened to the complementary housing 50.

When the lance block 70 is accommodated inside the concavity 54 of the complementary housing 50, the second partition walls 72 of the lance block 70 are aligned in the left-right direction and vertical direction with the first partition walls 52*a* of the complementary housing 50 as shown in FIG. 10B. Furthermore, the lance block through-holes 73 in the lance block 70 are aligned with the lower contact insertion holes 53 and second mating contact insertion holes 53*b* in the complementary housing 50.

Next, the side retainer 80 is inserted into the concavity 54 of the complementary housing 50 from the side of the undersurface of the complementary housing 50 and caused to be positioned in the temporary locking position shown in FIGS. 9A, 9B, and 10A-10C. In this temporary locking position, the third partition walls 82 of the side retainer 80 are aligned in the left-right direction with the second partition walls 72 of the lance block 70 as shown in FIG. 10B. Furthermore, the side retainer through-holes 83 in the side retainer 80 are aligned with the lower contact insertion holes 53 in the complementary housing 50 and the lance block through-holes 73 in the lance block 70 as shown in FIG. 9A.

Then, as is shown in FIG. 9B, in the temporary locking position of the side retainer 80, the respective upper complementary contacts 91 are accommodated from the rear of the complementary housing 50 toward the front between the first partition walls 52*a* of the complementary housing 50 by passing through the upper contact insertion holes 52 in the upper row, between the third partition walls 82 of the side retainer 80, and between the second partition walls 72 of the lance block 70. Then, the primary locking of the respective upper complementary contacts 91 is accomplished by the upper elastic lances 72*a* of the lance block 70. In this case, the respective upper complementary contacts 91 are disposed coaxially with the respective first mating contact insertion holes 52*b*.

Furthermore, as is shown in FIG. 9A, in the temporary locking position of the side retainer 80, the respective lower complementary contacts 95 are accommodated from the rear of the complementary housing 50 toward the front in the lance block through-holes 73 of the lance block 70 by passing through the lower contact insertion holes 53 in the lower row and the side retainer through-holes 83 in the side retainer 80. Then, the primary locking of the respective lower complementary contacts 95 is accomplished by the lower elastic lances 73*a* of the lance block 70. In this case, the respective lower complementary contacts 95 are disposed coaxially with the respective second mating contact insertion holes 53*b*.

Figure 11A:
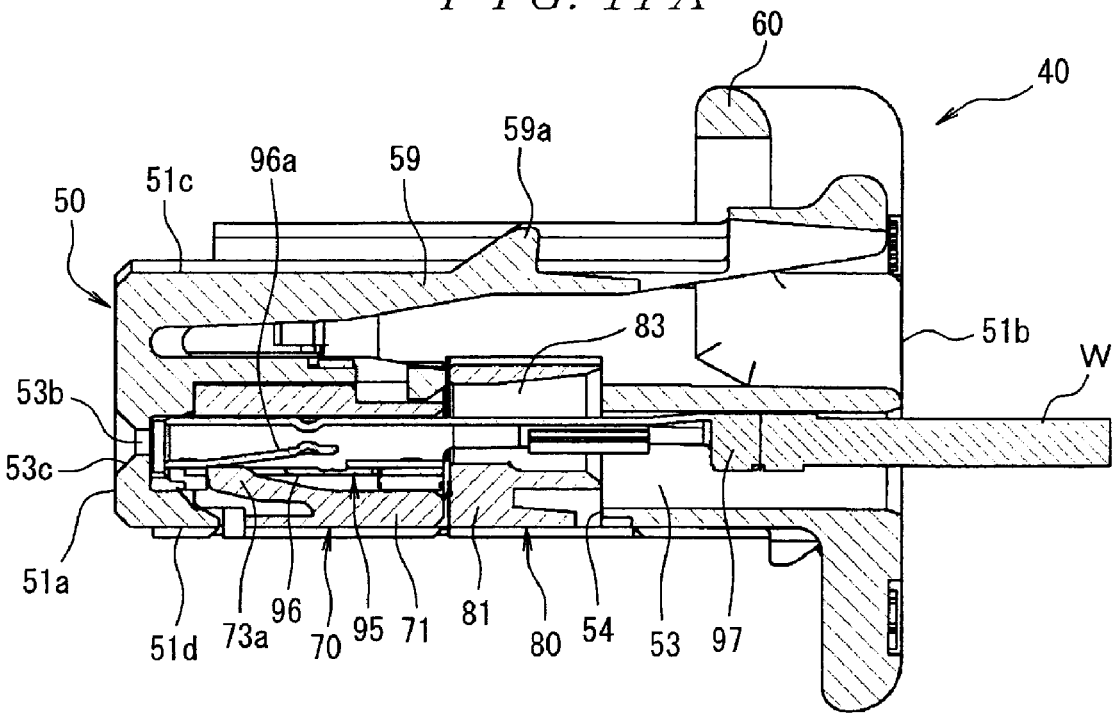
FIG. 11A is a cross-sectional view of the complementary connector of FIG. 1A taken along line 9A-9A in FIG. 8 and shows a state in which the side retainer is in the main locking position in the complementary connector.
Figure 11B:
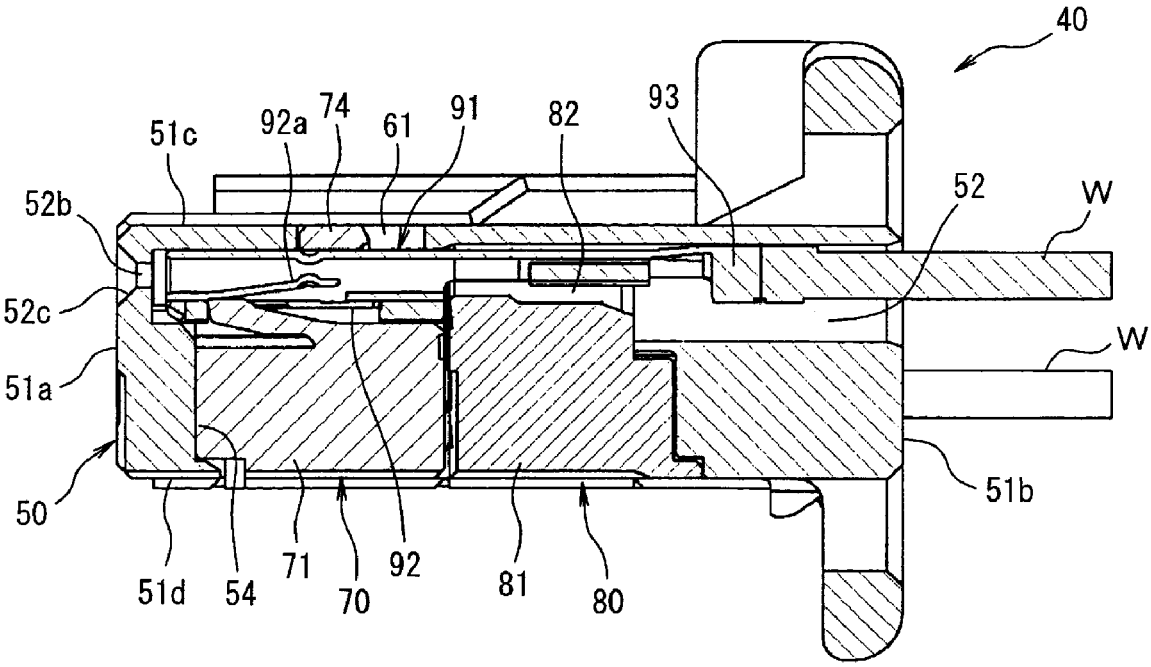
FIG. 11B is a cross-sectional view of the complementary connector of FIG. 1A taken along line 9B-9B in FIG. 8 and shows a state in which the side retainer is in the main locking position in the complementary connector.

Next, the side retainer 80 is moved further upward so as to be positioned in the main locking position as shown in FIGS. 11A and 11B. In this main locking position, as is shown in FIG. 12B, the third partition walls 82 of the side retainer 80 are aligned in the vertical direction with the second partition walls 72 of the lance block 70, and as is shown in FIG. 11B, the front end surface of the side retainer base 81 below the third partition walls 82 performs the secondary locking of the upper complementary contacts 91, so that the upper complementary contacts 91 are prevented from slipping out. At the same time, as is shown in FIG. 12B, the side retainer through-holes 83 in the side retainer 80 are positioned slightly above the lower contact insertion holes 53 in the complementary housing 50, and as is shown in FIG. 11A, the front end surface of the side retainer base 81 below the side retainer through-holes 83 performs the secondary locking of the lower complementary contacts 95, so that the lower complementary contacts 95 are prevented from slipping out. As a result of the secondary locking of the upper complementary contacts 91 and lower complementary contacts 95 by means of the side retainer 80, the complementary connector 40 is completed.

When the complementary connector 40 thus completed mates with the first connector 10 in the mating direction (direction indicated by arrow C in FIG. 2), the first contact parts 32 of the first contacts 30 of the first connector 10 contact the upper contact parts 92 of the upper complementary contacts 91 and the lower contact parts 96 of the lower complementary contacts 95 of the complementary connector 40, so that the circuit board connected to the first contacts 30 are electrically connected to the electrical wires W connected to the upper complementary contacts 91 and lower complementary contacts 95. During the mating of the complementary connector 40 and first connector 10, the complementary housing 50 of the complementary connector 40 is received inside the complementary connector receiving concavity 21 of the first housing 20. Then, the complementary locking projection 59*a* of the complementary connector 40 engages with the first locking projection 24*b* of the first connector 10. In this mating state, the complementary connector 40 is prevented from being pulled out of the first connector 10 by the locking force between the complementary locking projection 59*a* of the complementary connector 40 and the first locking projection 24*b* of the first connector 10 and also by the contact force between the upper complementary contacts 91 and lower complementary contacts 95 of the complementary connector 40 and the first contacts 30 of the first connector 10.

During this mating, furthermore, the first connector projections 25 of the first housing 20 are successively fitted into the first grooves 66*a* in the complementary housing 50, the second grooves 66*b* in the lance block 70, and the third grooves 66*c* in the side retainer 80, and thus restrict the displacement of the complementary housing 50 in the vertical direction (direction indicated by arrow D in FIG. 2). Moreover, the side projections 62 of the complementary housing 50 are received by the first connector concavities 27 of the first housing 20, and thus restrict the displacement of the complementary housing 50 in the vertical direction. As a result, it is possible to provide an electrical connector assembly 1 which can manifest strength against the driving of the complementary connector 40 in the vertical direction without increasing the wall thickness of the first housing 20 in the first connector 10. Here, this electrical connector assembly is devised so that the first connector projections 25 provided on the first housing 20 have the protruding parts 25*a* that protrude in a direction perpendicular to the connector mating direction (forward-rearward direction), and so that the first connector projections 25 that include these protruding parts 25*a* are fitted into the first grooves 66*a* in the complementary housing 50, the second grooves 66*b* in the lance block 70, and the third grooves 66*c* in the side retainer 80. Accordingly, the displacement of the complementary housing 50 in the vertical direction can be securely restricted.

In particular, because the first connector 10 is mounted on the circuit board, the complementary connector 40 that mates with this first connector 10 tends to be driven in the upward direction, and the electrical connector assembly 1 can exhibit an especially high level of strength against the driving of this complementary connector 40 in the upward direction.

In addition, the projection ribs 24 and first connector projections 25 provided on the first connector 10 have the function of preventing the deformation (preventing so-called twisting) of the male-type first contacts 30 caused by the corner portions or the like of the complementary connector 40 and the function of preventing the upside-down insertion of the complementary connector 40.

An embodiment of the present invention has been described above. However, the present invention is not limited to this embodiment, and various alterations or modifications can be made.

For example, it is not absolutely necessary to dispose the first contacts 30 provided on the first connector 10 in two rows (upper and lower rows). The contacts may be in a single row or in three or more rows; alternatively, a single contact may also be used.

Furthermore, it is not absolutely necessary to provide a lance block 70 and a side retainer 80 on the complementary connector 40; the complementary connector 40 may also be constructed from a complementary housing 50 and contacts attached to this complementary housing 50. In this case, the contacts do not necessarily need to be disposed in two rows (upper and lower rows); the contacts may be in a single row or in three or more rows; alternatively, a single contact may also be used. Moreover, in cases where no lance block 70 or side retainer 80 is provided, grooves that are relatively long in the connector mating direction are formed in the complementary housing 50 so that the first connector projections 25 of the first connector 10 are fitted into these grooves.

In addition, it would also be possible to construct the first contacts 30 attached to the first housing 20 as female-type contacts, and to construct the contacts attached to the complementary housing 50 as male-type contacts.

What is claimed is:

1. An electrical connector assembly, comprising:

a first connector comprising a first housing, the first housing comprising:

a complementary connector receiving concavity;

a first contact attached to the first housing;

a first connector projection extending in a connector mating direction, the first connector projection formed on an inside of a lower wall and comprising a protruding part that is provided at the top of the first connector projection and that protrudes in a horizontal direction substantially perpendicular to the connector mating direction; and a first connector concavity formed on an inside of a side wall of the complementary connector receiving cavity and extends in the connector mating direction and is recessed in a direction substantially perpendicular to the connector mating direction; and a complementary connector that mates with the first connector, the complementary connector comprising a complementary housing received by the complementary connector receiving concavity, the complementary housing comprising:

a complementary contact attached to the complementary housing;

a groove formed in an undersurface of the complementary housing and having a cross-sectional shape that is complementary to a cross-sectional shape of the first connector projection and extending in the connector mating direction; and a side projection provided on a side surface of the complementary housing and extending in the connector mating direction, the side projection having a cross-sectional shape that is complementary to a cross-sectional shape of the first connector concavity;

wherein displacement of the complementary housing with respect to the first housing in a vertical direction is restricted by the first connector projection being received in the groove and by the side projection being received in the first connector concavity.

2. The electrical connector assembly according to claim 1, wherein the first contact is a male-type contact and the complementary contact is a female-type contact.

3. The electrical connector assembly according to claim 1, further comprising:

a plurality of the first contacts attached to the first housing substantially in a row and a plurality of the complementary contacts attached to the complementary housing substantially in a row.

4. The electrical connector assembly according to claim 1, wherein the first contact is substantially pin-shaped and the complementary contact is substantially box-shaped.

5. An electrical connector assembly, comprising:

a first connector comprising a first housing, the first housing comprising:

a complementary connector receiving concavity;

a first contact attached to the first housing; and a first connector projection extending in a connector mating direction, the first connector projection formed on an inside of a lower wall and comprising a protruding part that is provided at the top of the first connector projection and that protrudes in a horizontal direction substantially perpendicular to the connector mating direction; and a complementary connector that mates with the first connector, the complementary connector comprising a complementary housing received by the complementary connector receiving concavity, the complementary housing comprising:

a complementary contact attached to the complementary housing; and a groove formed in an undersurface of the complementary housing and having a cross-sectional shape that is complementary to a cross-sectional shape of the first connector projection and extending in the connector mating direction;

wherein displacement of the complementary housing with respect to the first housing in a vertical direction is restricted by the first connector projection being received in the groove.

6. The electrical connector assembly according to claim 5, wherein the first contact is a male-type contact and the complementary contact is a female-type contact.

7. The electrical connector assembly according to claim 5, further comprising:

a plurality of the first contacts attached to the first housing substantially in a row and a plurality of the complementary contacts attached to the complementary housing substantially in a row.

8. The electrical connector assembly according to claim 1, wherein the first contact is substantially pin-shaped and the complementary contact is substantially box-shaped.

* * * * *